US012745871B2

(12) United States Patent
Newholm

(10) Patent No.: US 12,745,871 B2
(45) Date of Patent: Sep. 29, 2026

(54) SECURE PACKAGE DROP BOX AND METHOD OF USING THE SAME

(71) Applicant: Joshua Newholm, Detroit Lakes, MN (US)

(72) Inventor: Joshua Newholm, Detroit Lakes, MN (US)

( * ) Notice: Subject to any disclaimer, the term of this patent is extended or adjusted under 35 U.S.C. 154(b) by 0 days.

(21) Appl. No.: 18/515,088

(22) Filed: Nov. 20, 2023

(65) Prior Publication Data

US 2024/0164561 A1 May 23, 2024

Related U.S. Application Data

(60) Provisional application No. 63/426,984, filed on Nov. 21, 2022.

(51) Int. Cl.

| | |
|---|---|
| ***A47G 29/22*** | (2006.01) |
| ***A47C 7/62*** | (2006.01) |
| ***A47C 11/00*** | (2006.01) |
| ***A47G 29/14*** | (2006.01) |

(52) U.S. Cl.

CPC ..... *A47G 29/22* (2013.01); *A47C 7/628* (2018.08); *A47C 11/00* (2013.01); *A47G 29/141* (2013.01)

(58) Field of Classification Search

CPC ..... A47G 29/141; A47G 29/20; A47G 29/22; A47G 29/12095; A47G 29/1245; A47G 29/126; A47G 29/1248; A47G 29/1251; A47C 11/00; A47C 7/628

See application file for complete search history.

(56) References Cited

U.S. PATENT DOCUMENTS

| | | | | | |
|---|---|---|---|---|---|
| 74,015 | A * | 2/1868 | Smith et al. | A47G 29/12095 | 232/49 |
| 357,143 | A * | 2/1887 | Bush | A47G 29/12095 | 232/53 |
| 384,154 | A * | 6/1888 | Harrigan | A47G 29/1207 | 232/49 |
| 393,331 | A * | 11/1888 | Giffard | A47G 29/12095 | 232/53 |
| 560,477 | A * | 5/1896 | Cook | A47G 29/1207 | 232/50 |
| 561,589 | A * | 6/1896 | Hower | A47G 29/12095 | 232/49 |
| 570,628 | A * | 11/1896 | Gaschlin | A47G 29/12095 | 232/49 |
| 652,916 | A * | 7/1900 | Kline | A47G 29/16 | 232/51 |
| 777,026 | A * | 12/1904 | Jones et al. | A47G 29/1207 | 43/67 |

(Continued)

*Primary Examiner* — William L Miller

(74) *Attorney, Agent, or Firm* — Fargo Patent & Business Law; Thomas Kading

(57) ABSTRACT

A package-storing assembly according to one disclosed non-limiting embodiment of the present disclosure comprises an arcuate planar surface positioned adjacent an opening of a structure, the arcuate planar surface having an opening therethrough; and a security screen slidably engaged with the arcuate planar surface, the security screen supported to transition between a closed position and an open position, wherein the security screen inhibits access through the opening in the closed position, and cooperates with a lid to inhibit access to the opening in the open position.

33 Claims, 15 Drawing Sheets

(56) References Cited

U.S. PATENT DOCUMENTS 3,322,477 A * 5/1967 Armijo ..... B65F 7/00 248/101
6,918,534 B2 * 7/2005 Fitzgibbons ..... A47G 29/1207 232/50
7,114,645 B2 * 10/2006 Felice ..... A47G 29/22 232/30
7,428,980 B2 * 9/2008 Irwin ..... E05G 7/001 232/51
7,506,797 B2 * 3/2009 Felice ..... A47G 29/22 232/52
7,549,572 B1 * 6/2009 Branan ..... A47G 29/22 232/52
8,573,473 B1 * 11/2013 Farentinos ..... A47G 29/22 232/51
10,039,401 B1 * 8/2018 Romanucci ..... A47G 29/141
10,251,503 B1 * 4/2019 Fulps ..... A47G 29/1251
10,638,848 B1 * 5/2020 Wesley ..... A47C 11/00
11,478,099 B1 * 10/2022 Bates ..... A47G 29/141
11,506,445 B2 * 11/2022 Lubben ..... F25D 23/12
12,484,730 B2 * 12/2025 Davison ..... A47G 29/1248
2018/0070753 A1 * 3/2018 Eveloff ..... H04W 4/025
2018/0303265 A1 * 10/2018 Hearne ..... A47G 29/12095
2018/0310714 A1 * 11/2018 Becker ..... B65D 43/16
2019/0000255 A1 * 1/2019 Dehner ..... B65D 43/26
2019/0239650 A1 * 8/2019 Nelson ..... E05B 65/5284
2019/0313826 A1 * 10/2019 Bickford ..... B65D 15/22
2019/0387910 A1 * 12/2019 Stoich ..... G07C 9/33
2020/0121087 A1 * 4/2020 Kilburn ..... A47C 11/00
2020/0121088 A1 * 4/2020 Chasnis, II ..... A47C 7/72
2020/0138224 A1 * 5/2020 Isreal ..... A47G 29/22
2020/0163480 A1 * 5/2020 Waisanen ..... E05B 65/06
2020/0237946 A1 * 7/2020 Shell ..... A61L 2/28
2020/0268187 A1 * 8/2020 Thomas ..... A47G 29/20
2020/0390260 A1 * 12/2020 Romanucci ..... A47G 29/141
2021/0177150 A1 * 6/2021 Liu ..... A47G 29/20
2022/0022680 A1 * 1/2022 Farentinos ..... A47G 29/20
2022/0031104 A1 * 2/2022 Rodgers ..... A47G 29/30
2022/0142388 A1 * 5/2022 Foster ..... A47G 29/141
2022/0338658 A1 * 10/2022 Soderberg ..... A47G 29/141
2023/0032389 A1 * 2/2023 Barros ..... E05B 47/026
2023/0200578 A1 * 6/2023 Chhina ..... A47G 29/1251 232/24
2023/0414026 A1 * 12/2023 Williams ..... A47G 29/30
2024/0002115 A1 * 1/2024 Chernykh ..... B65D 51/18

* cited by examiner

SECURE PACKAGE DROP BOX AND METHOD OF USING THE SAME

CROSS REFERENCE TO RELATED APPLICATION[S]

The present disclosure claims priority to U.S. Provisional Patent Application No. 63/426,984 filed Nov. 21, 2022.

BACKGROUND

The present disclosure relates to a secure package drop box, and more specifically, to a secure package drop box that can be used as a bench.

Mailboxes and package drop boxes are used to receive mail and packages. Traditionally, single-family residences were constructed with a mailbox in the front yard, and multi-family residences were constructed with clustered mailboxes and package drop boxes. More recently, single-family residential neighborhoods have been constructed with clustered mailboxes and package drop boxes.

Increases in online ordering and corresponding package delivery services have significantly increased the number of packages being delivered. Many delivery services, however, do not leave packages in traditional mailboxes or traditional package drop boxes. Instead, many delivery services leave packages outside the residence, such as on the front porch, at a door, on the driveway, etc. As a result, packages are an easy target for porch pirates.

SUMMARY

A package-storing assembly according to one disclosed non-limiting embodiment of the present disclosure comprises an arcuate planar surface positioned adjacent an opening of a structure, the arcuate planar surface having an opening therethrough; and a security screen slidably engaged with the arcuate planar surface, the security screen supported to transition between a closed position and an open position, wherein the security screen inhibits access through the opening in the closed position, and cooperates with a lid to inhibit access to the opening in the open position.

A further embodiment of any of the foregoing embodiments of the present disclosure includes that the security screen forms an arcuate planar surface when in the closed position, the security screen centers a package over the opening in response to a package placed on the arcuate planar surface.

A further embodiment of any of the foregoing embodiments of the present disclosure includes that the security screen covers the opening of the structure in the closed position, wherein transitioning the security screen from the closed position to the open position uncovers the opening of the structure such that a package moves through the opening.

A further embodiment of any of the foregoing embodiments of the present disclosure includes that the package moves from a staging compartment outside the structure to a storage compartment within the structure.

A further embodiment of any of the foregoing embodiments of the present disclosure includes that the staging compartment is defined by an inner surface of the lid and a first surface of the security screen when the security screen is in the closed position, wherein the package is placed in the staging compartment when the security screen is in the closed position.

A further embodiment of any of the foregoing embodiments of the present disclosure includes that the storage compartment is defined by an inner surface of the structure and a second surface of the security screen when the security screen is in the closed position, wherein the storage compartment receives the package from the staging compartment such that the package is securely stored within the storage compartment.

A further embodiment of any of the foregoing embodiments of the present disclosure includes that the security screen extends to the lid to form a top wall over a staging compartment in the open position, wherein the top wall inhibits access to the staging compartment.

A further embodiment of any of the foregoing embodiments of the present disclosure includes that the security screen aligns with fins of the lid to form sidewalls around a staging compartment in the open position, the sidewalls inhibit access to the staging compartment.

A further embodiment of any of the foregoing embodiments of the present disclosure includes that the lid has a first end and a second end and defines an inner surface, wherein a first fin extends from the inner surface at the first end of the lid and a second fin extends from the inner surface at the second end of the lid, wherein when the security screen is in the open position the security screen aligns with the first fin and the second fin such that access to the opening of the structure is inhibited.

A further embodiment of any of the foregoing embodiments of the present disclosure includes that the security screen extends to the inner surface of the lid such that access to the opening of the structure is inhibited in the open position.

A further embodiment of any of the foregoing embodiments of the present disclosure includes that the lid is operable to transition between a closed position and an open position, wherein when the lid is in the closed position the first fin and the second fin are positioned within the structure, wherein the lid inhibits access to the opening of the structure when the lid is in the closed position.

A further embodiment of any of the foregoing embodiments of the present disclosure includes that when the lid is in the open position and the security screen is in the open position the security screen aligns with the first fin and the second fin to form sidewalls around the opening of the structure, wherein the sidewalls inhibit access to the opening when the lid is in the open position and the security screen is in the open position.

A further embodiment of any of the foregoing embodiments of the present disclosure includes that when the lid is in the open position and the security screen is in the open position, the security screen extends to the lid to form a top wall over the opening of the structure, wherein the top wall inhibits access to the opening when the lid is in the open position and the security screen is in the open position.

A further embodiment of any of the foregoing embodiments of the present disclosure includes that when the lid is in the open position and the security screen is in the closed position the inner surface of the lid, the first fin, the second fin, and an outer surface of the security screen define a staging compartment, wherein a package is placed in the staging compartment.

A further embodiment of any of the foregoing embodiments of the present disclosure includes that when the security screen is transitioned from the closed position to the open position, the package drops from the staging compartment into a storage compartment, wherein the storage compartment is defined by an inner surface of the structure.

A further embodiment of any of the foregoing embodiments of the present disclosure includes that the lid and the security screen inhibit access to the package within the storage compartment.

A further embodiment of any of the foregoing embodiments of the present disclosure includes that the lid defines an outer surface, wherein the outer surface is substantially parallel to a horizontal plane when the lid is in the closed position, wherein the outer surface of the lid defines a bench seat when the lid is in a closed position.

A further embodiment of any of the foregoing embodiments of the present disclosure comprises a second arcuate planar surface, the arcuate planar surface and the second arcuate planar surface forming a track, wherein the security screen is slidably engaged with the track.

A further embodiment of any of the foregoing embodiments of the present disclosure includes that the structure has four sidewalls and a bottom wall, wherein four or more feet are coupled to the bottom wall, wherein at least one of the four or more feet contains an aperture configured to receive a connector therethrough to secure the structure to a horizontal surface.

A further embodiment of any of the foregoing embodiments of the present disclosure includes that an access door is positioned over a second opening in the structure, the access door operable to transition between a closed position and an open position, wherein the access door inhibits access to a storage compartment when the access door is in the closed position, wherein the access door allows access to the storage compartment when the access door is in the open position, wherein the access door comprises a lock, wherein the lock secures the access door in the closed position when the lock is engaged.

A package-storing device according to one disclosed non-limiting embodiment of the present disclosure comprises a body having at least four sidewalls; a lid hingedly connected to the body, the lid having a first end and a second end, the lid defining an outer surface and an inner surface, wherein the lid is operable to transition from a closed position to an open position; a first fin extending from the inner surface at the first end of the lid and a second fin extending from the inner surface at the second end of the lid; a chute defining an outer surface and an inner surface and having a central opening therethrough; a security door defining a first surface and a second surface, the security door operable to transition from a closed position to an open position; and an access door through one of the at least four sidewalls, the access door operable to move between an open position and a closed position, wherein a lock secures the access door in the closed position, wherein when the lid is in the open position, the inner surface of the lid, the first fin, the second fin, and the first surface of the security door define a portion of a staging compartment configured to receive a package, wherein the at least four sidewalls and the inner surface of the chute define a portion of a storage compartment, the storage compartment configured to store one or more packages.

A further embodiment of any of the foregoing embodiments of the present disclosure comprises wherein when the security door is in the closed position the second surface of the security door is in contact with the outer surface of the chute and the security door covers the central opening of the chute, and wherein when the security door is in the open position the security door uncovers the central opening of the chute and a portion of the second surface of the security door extends from one of the at least four sidewalls of the body towards the lid.

A further embodiment of any of the foregoing embodiments of the present disclosure includes that the security door is operable to receive a package from the staging compartment to the storage compartment when the security door transitions from a closed position to an open position.

A further embodiment of any of the foregoing embodiments of the present disclosure includes that the security door inhibits access to the storage compartment when the lid is in the open position and the security door is in the closed position.

A further embodiment of any of the foregoing embodiments of the present disclosure includes that the first fin, the second fin, and the security door inhibit access to the storage compartment when the lid is in the open position and the security door is in the open position.

A further embodiment of any of the foregoing embodiments of the present disclosure includes that the outer surface of the chute is semi-cylindrical in shape, wherein the security door is semi-cylindrical in shape when the security door is in the closed position.

A further embodiment of any of the foregoing embodiments of the present disclosure includes that the central opening through the chute is rectangular in shape.

A further embodiment of any of the foregoing embodiments of the present disclosure includes that the outer surface of the lid is substantially parallel to a horizontal plane when the lid is in the closed position, wherein the outer surface of the lid defines a bench seat.

A further embodiment of any of the foregoing embodiments of the present disclosure includes that the at least four sidewalls include a front sidewall, a rear sidewall opposite the front sidewall, a left sidewall, and a right sidewall opposite the left sidewall.

A further embodiment of any of the foregoing embodiments of the present disclosure includes that the front sidewall is parallel to the rear sidewall, wherein the left sidewall is parallel to the right sidewall.

A further embodiment of any of the foregoing embodiments of the present disclosure includes that the first fin and the second fin are perpendicular to the inner surface of the lid and parallel to the left sidewall and right sidewall of the body.

A further embodiment of any of the foregoing embodiments of the present disclosure includes that the access door comprises a drawer that is operable to slidably open and close.

A further embodiment of any of the foregoing embodiments of the present disclosure includes that the access door is hingedly connected to the body.

A further embodiment of any of the foregoing embodiments of the present disclosure includes that the lock is a key lock that comprises a latch configured to engage one of the at least four sidewalls.

A further embodiment of any of the foregoing embodiments of the present disclosure includes that the security door is manufactured of a flexible material.

A further embodiment of any of the foregoing embodiments of the present disclosure includes that the body comprises a bottom wall defining an outer surface and an inner surface, wherein four or more feet are coupled to the outer surface of the bottom wall of the body, wherein at least one of the four or more feet contains an aperture configured to receive a connector therethrough to secure the body of the package-storing device.

A further embodiment of any of the foregoing embodiments of the present disclosure includes that one of the four or more sidewalls comprises a spacer bar coupled to an outer surface, the spacer bar operable to receive a connector therethrough to couple the body of the package-storing device to a vertical surface.

The present disclosure relates to a package drop box that can receive and securely store one or more packages. The package drop box comprises a base, a guide, a security screen, and a lid. The base comprises an opening and an internal storage compartment. The storage compartment receives the package through the opening in the base. Then, the storage compartment securely stores the package until an authorized user opens an access door through the base and retrieves the package from the storage compartment. The guide covers the opening in the base and contains a central opening, through which the package is received into the storage compartment. The guide comprises a track, which allows the security screen to slide open and slide closed.

When it is closed, the security screen covers the opening in the base to prevent access to the storage compartment. A package can be placed on the security screen and the security screen can be opened to cause the package to drop through the central opening of the guide and into the storage compartment of the base. When it is open, the orientation of the security screen with respect to the lid prevents access to the storage compartment.

The lid can be located over the opening in the base and the corresponding guide. The lid can be hingedly connected to the base, which allows the lid to open and close. When it is closed, the lid can serve as a sitting bench. The lid can be opened to reveal the guide and the security screen so that, with the security screen in the closed position, the package can be placed on the security screen. Then, as previously described, the security screen can be opened to deliver the package to the storage compartment. After delivering the package, the security screen and the lid can both be closed, and the lid can be used as a bench.

The package drop box is convenient for a delivery person delivering the package to the storage compartment. For example, the delivery person can open the lid, place a package on the security screen, open the security screen to deliver the package, and close the security screen and lid. The package drop box is convenient for an authorized person, such as the package recipient. For example, the package drop box prevents an unauthorized person from accessing the storage compartment. However, the authorized person can open an access door through the base and retrieve the package from the storage compartment.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIGS. 1A-1C illustrate both the lid and the security screen in the open position.

FIGS. 2A-2C illustrate both the security screen and the lid in the closed position.

DETAILED DESCRIPTION

FIGS. 1A-1C and FIGS. 2A-2C illustrate one example of a package-storing assembly 100, according to various aspects of the present disclosure. The package-storing assembly 100 can receive and securely store one or more packages. Although the examples provided herein generally relate to receiving and securely storing packages, the package-storing assembly 100 can also receive and securely store other mail (e.g., letters, postcards). Moreover, the package-storing assembly 100 can receive and securely store other items within the package-storing assembly 100 (e.g., bottled water deliveries, grocery deliveries). The package-storing assembly 100 can be scaled in size to store one or more small packages, medium packages, or large packages.

Figure 1A:
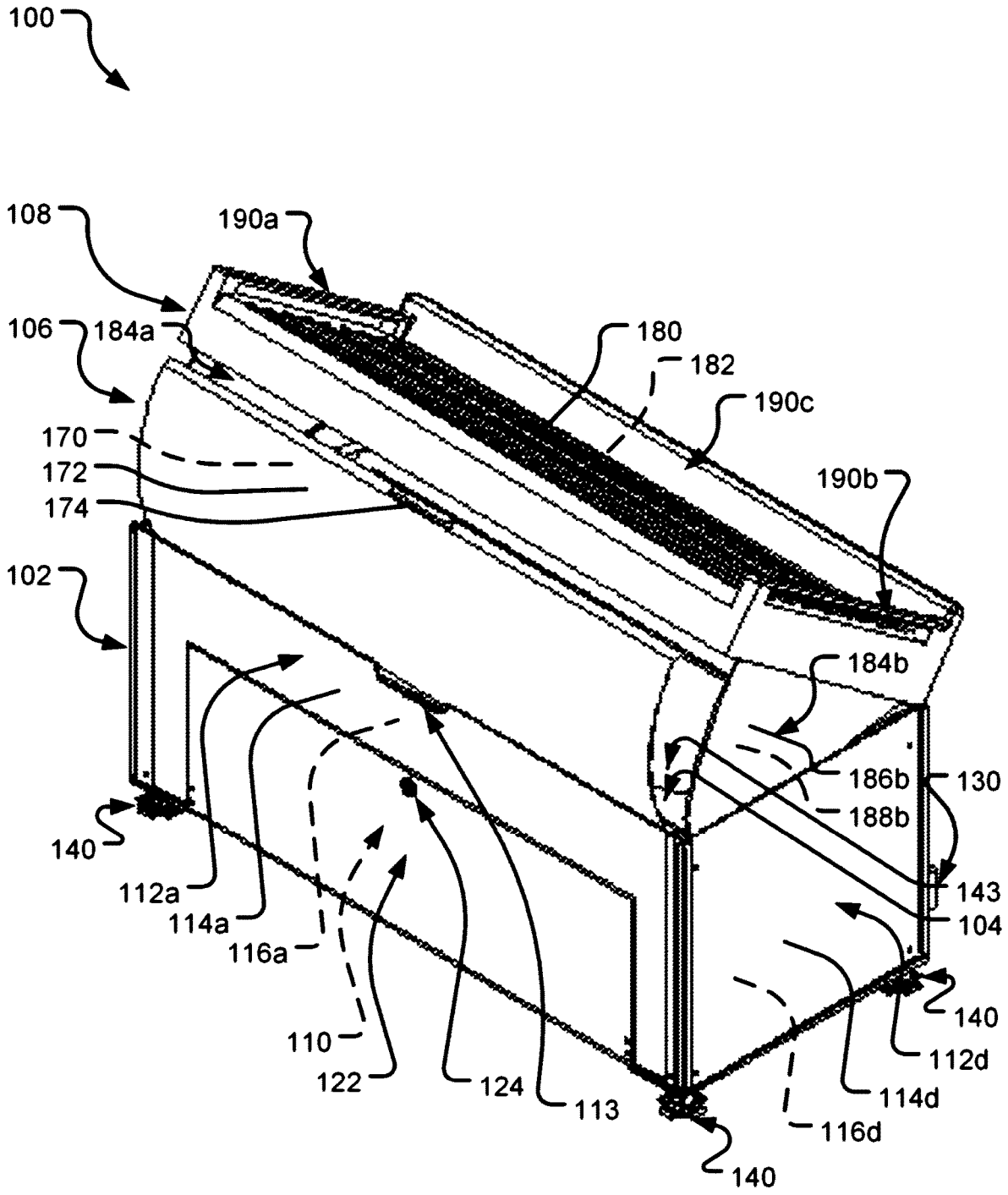
FIGS. 1A-1C illustrate one instance of a package-storing assembly in a perspective view, front-view, and side-view, respectively.
Figure 1B:
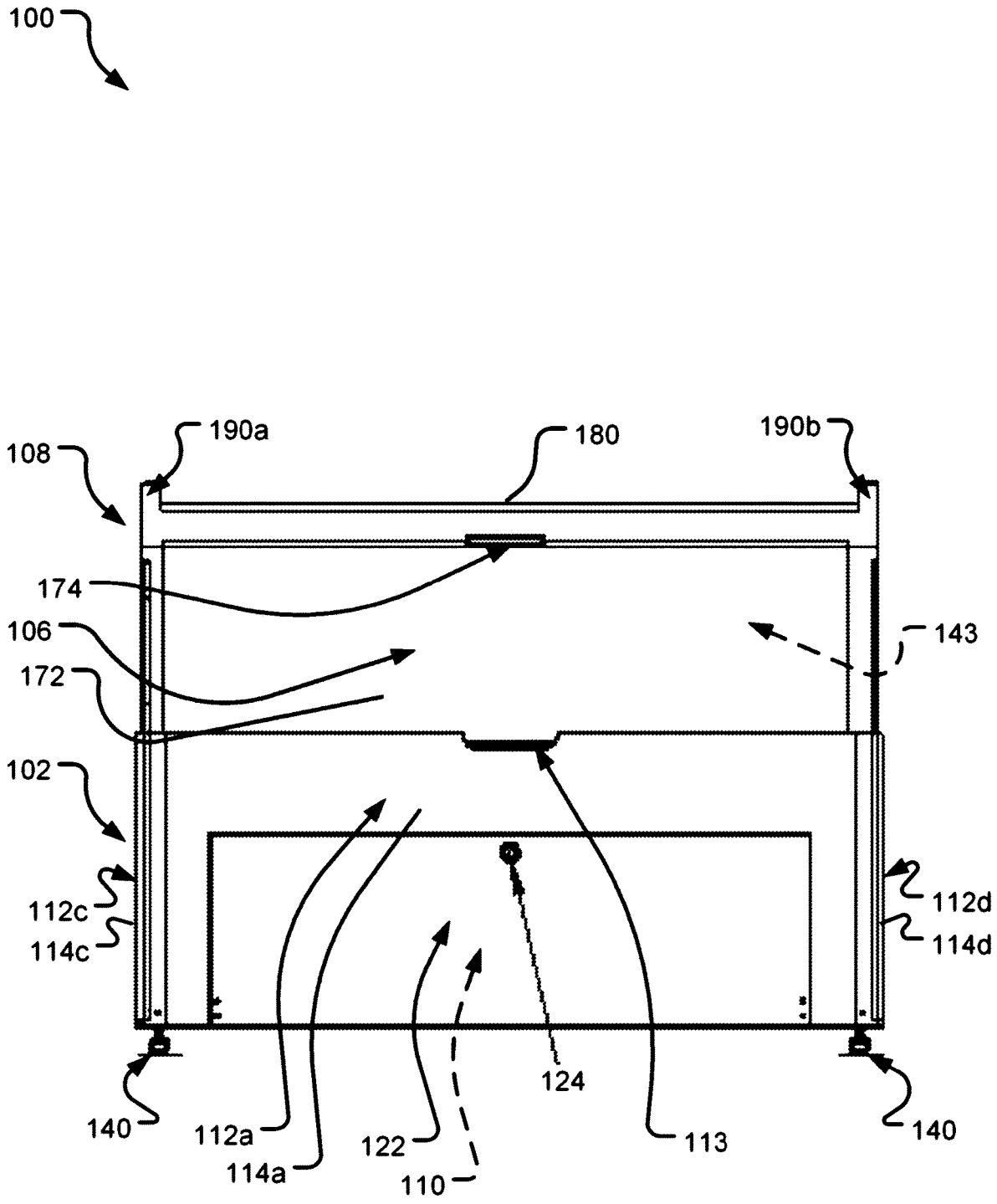
Figure 1C:
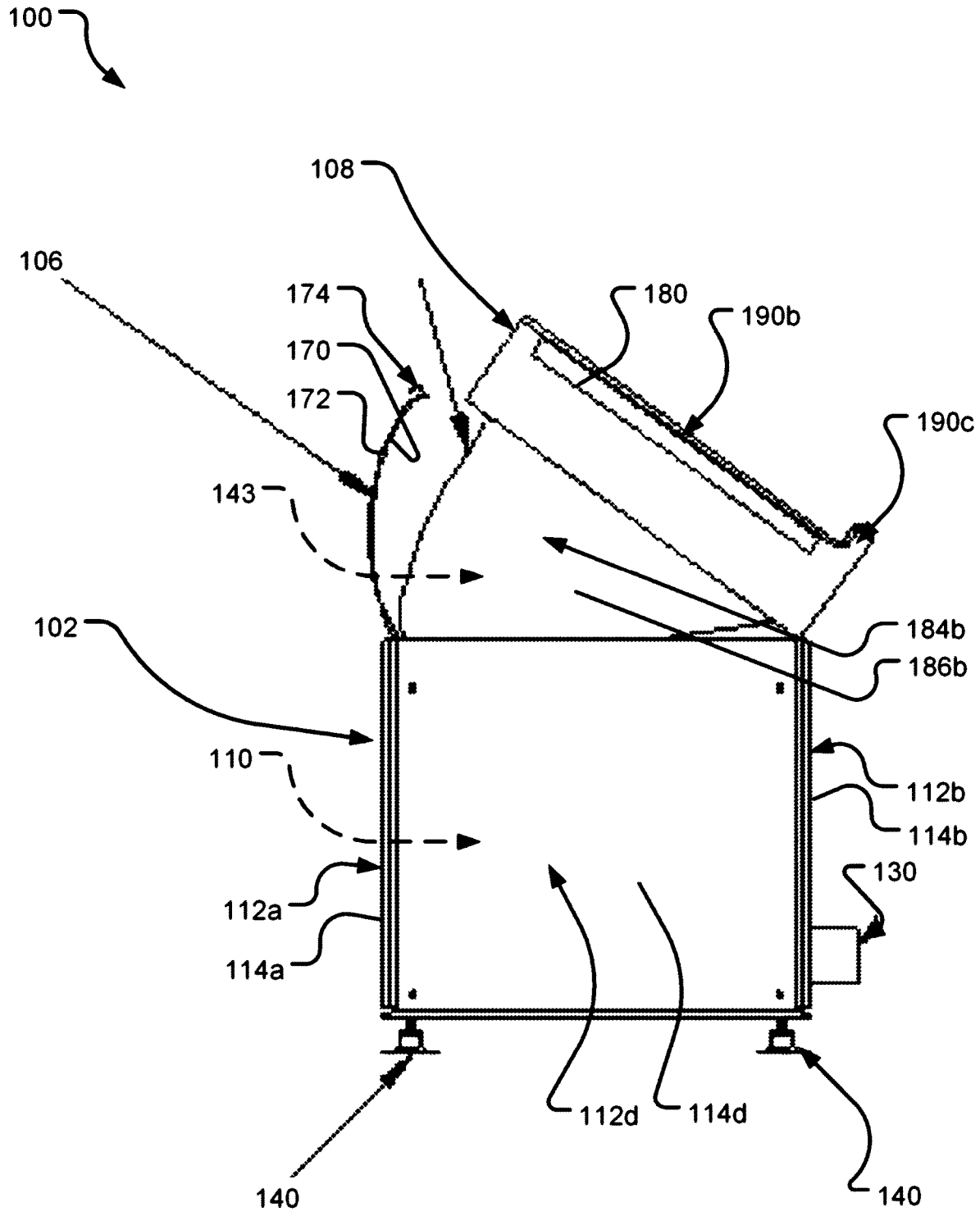
Figure 2A:
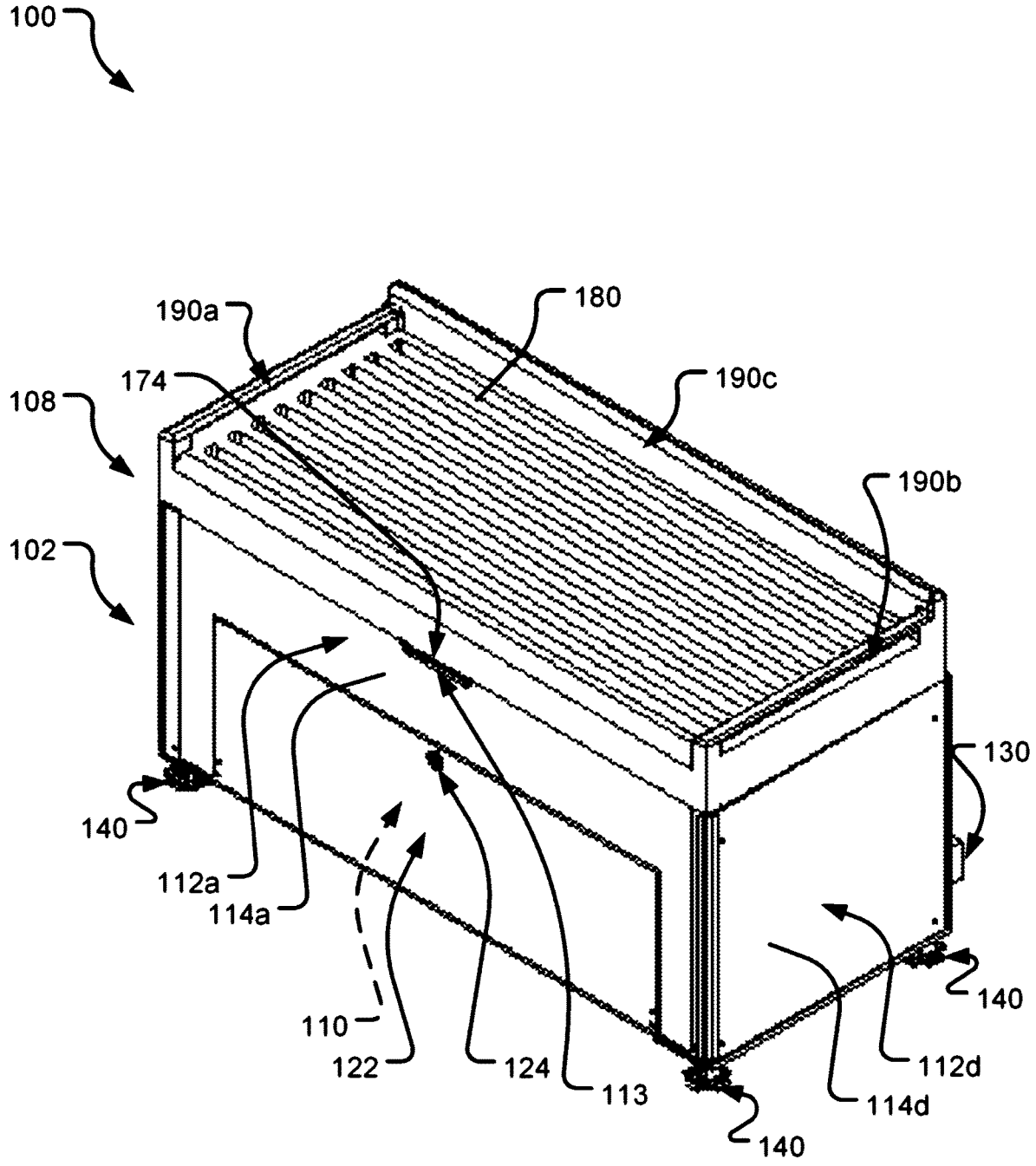
FIGS. 2A-2C illustrate one instance of a package-storing assembly in a perspective view, front-view, and side-view, respectively.
Figure 2B:
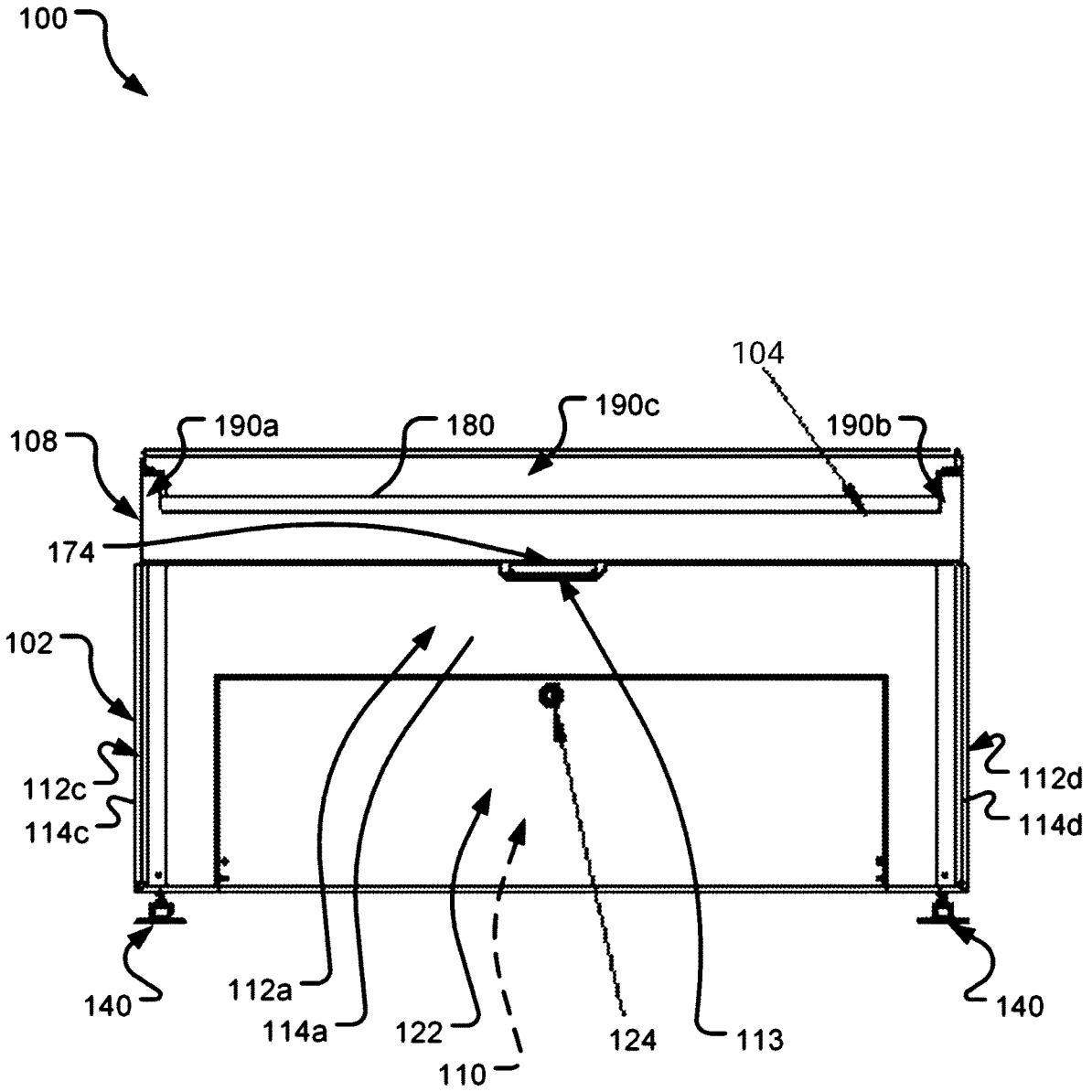
Figure 2C:
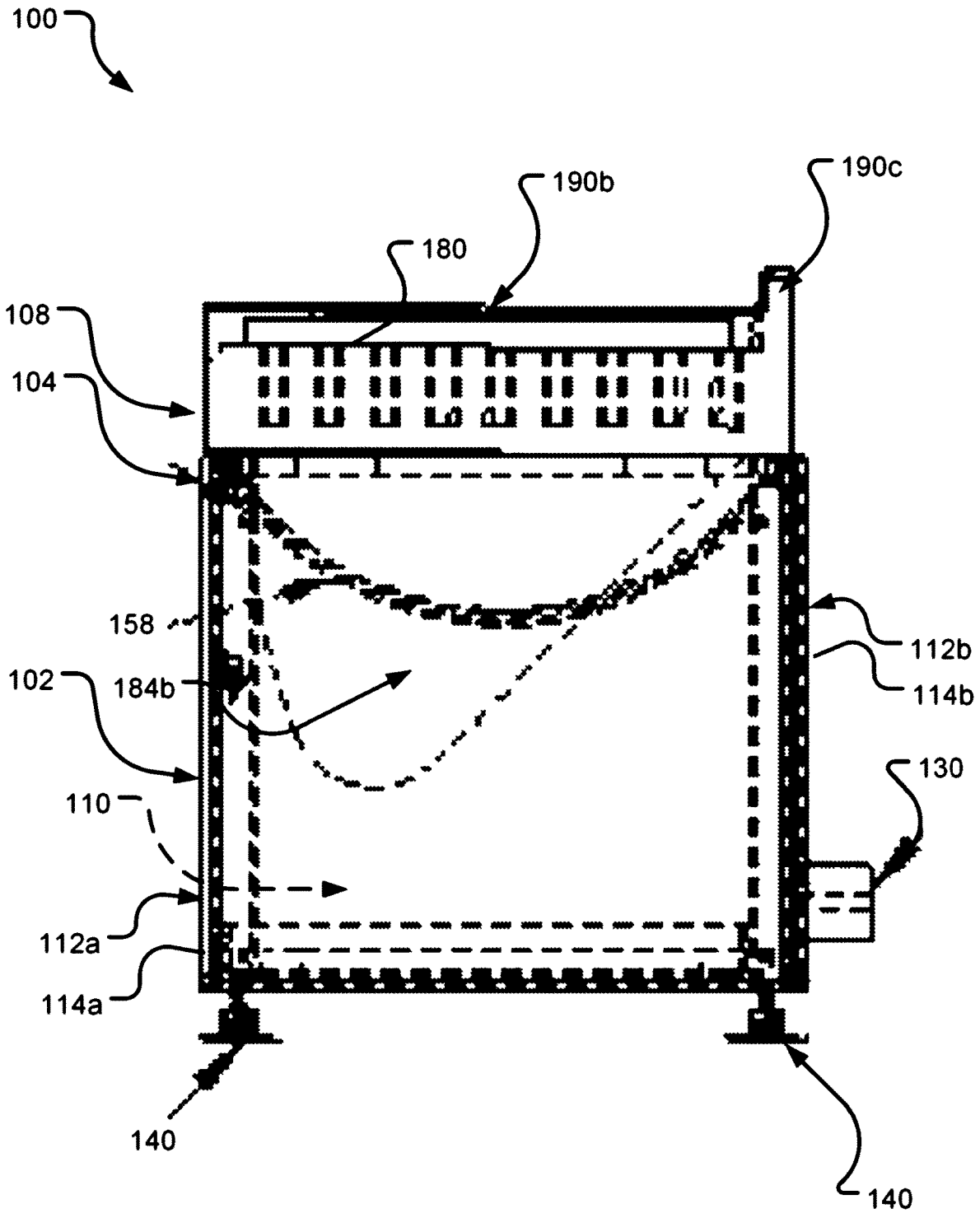

The package-storing assembly 100 comprises a structure 102, a guide 104, a security screen 106, and a lid 108. The security screen 106 can be operable to transition between a closed position and an open position. In some instances, the lid 108 can be operable to transition between a closed position and an open position. For example, FIGS. 1A-1C illustrate both the security screen 106 and the lid 108 in an open position. In contrast, FIGS. 2A-2C illustrate both the security screen 106 and the lid 108 in a closed position. In some instances, the security screen 106 and the lid 108 can transition between positions independent of each other. For example, the lid 108 can be in its open position while the security screen 106 is in its closed position.

The structure 102, the guide 104, the security screen 106, and/or the lid 108 can cooperate to inhibit access to the storage compartment 110 (e.g., storage area) when the security screen 106 is in various positions (e.g., open, closed) and/or the lid 108 is in various positions (e.g., open, closed). In other words, the structure 102, the guide 104, the security screen 106, and/or the lid 108 can hinder, hamper, restrain, block, obstruct, or otherwise prevent access. For example, one or more components of the assembly can inhibit access to a specific area of the assembly by creating a physical barrier. The physical barrier can prevent a person from accessing that specific area. In this manner, the package storing assembly 100 receives and securely stores a package in a storage compartment 110.

As described herein, a delivery person (e.g., postal carrier, delivery driver, courier) can deliver one or more packages to the storage compartment 110 of the package-storing assembly 100 to securely store the package. In this manner, the package-storing assembly 100 can receive the packages, securely store the packages, and allow retrieval of the packages by an authorized user (e.g., with a key, with a code).

For example, the security screen 106 and the lid 108 can both be in their closed positions, as illustrated in FIGS. 2A-2C. In this configuration, with the lid 108 and the security screen 106 in their closed positions, the lid 108 and the structure 102 inhibit access to the storage compartment 110. In some instances, the lid 108 can support one or more persons sitting on the lid 108 (e.g., a bench) when the lid 108 is in the closed position. In some examples, the storage compartment 110 can be empty. In other examples, the storage compartment 110 can already have one or more packages therein.

To deliver a package, the delivery person can open the lid 108, which reveals the security screen 106 in its closed position. In this configuration, with the lid 108 in its open position and the security screen 106 is in its closed position, the structure 102 and the security screen 106 define a barrier that inhibits access to the storage compartment 110. For example, in its closed position, the security screen 106 blocks access to the storage compartment 110.

Opening the lid 108 also provides a staging compartment 143 (e.g., staging area) in which the delivery person can place the package. Additionally, opening the lid 108 positions the fins 184 of the lid 108 so that when the security screen 106 is opened, the fins 184, in conjunction with the security screen 106, define a barrier to inhibit access to the storage compartment 110.

The delivery person can place the package on the security screen 106 within the staging compartment 143, with the security screen 106 remaining in its closed position. The security screen 106 and the structure 102 inhibit access to the storage compartment 110.

The delivery person can open the security screen 106, as illustrated in FIGS. 1A-1C. For example, the delivery person can grasp the handle 174 of the security screen 106 and pull the security screen 106 to its open position. Transitioning the security screen 106 to its open position causes the package to drop into the storage compartment 110 while also inhibiting access to the storage compartment 110. In this configuration, when the lid 108 is in its open position and the security screen 106 is in its open position, the structure 102, the security screen 106, and the lid 108 inhibit access to the storage compartment 110. For example, opening the security screen 106 forms a barrier with the lid 108, including the fins 184, that blocks external access into the storage compartment 110. The barrier can define one or more walls (e.g., top wall, sidewall) formed around the staging compartment 143 to inhibit access. When the security screen 106 is in its open position, the security screen 106 can extend to the lid 108 to form a top wall over the staging compartment 143. Moreover, when the security screen 106 is in its open position, the security screen 106 can align with the fins 184 of the lid 108 to form sidewalls around the staging compartment 143.

The delivery person can close both the security screen 106 and the lid 108, as illustrated in FIGS. 2A-2C. In this configuration, with the lid 108 and the security screen 106 in their closed positions, the lid 108 and the structure 102 inhibit access to the storage compartment 110, which comprises the package therein. The package-storing assembly 100 prevents an unauthorized person (e.g., without a key, without a code) from accessing the storage compartment 110 to remove the package therein.

An authorized user can open the access door 122 to retrieve the package from the storage compartment 110. Then, the authorized user can close the access door 122 and lock it to prevent an unauthorized person from accessing the storage compartment 110. In this manner, the storage compartment 110 is ready to receive and securely store another package in the future.

Figure 3A:
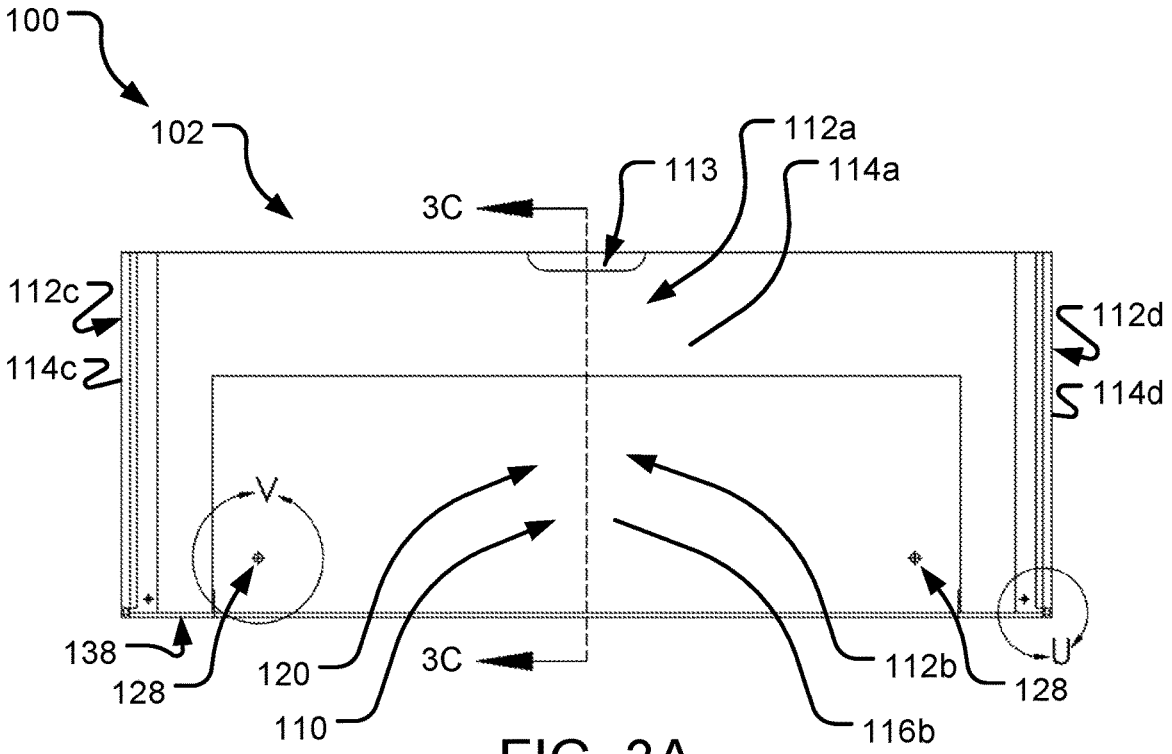
FIGS. 3A-3C illustrate one instance of a structure in a front-view, top-view, and cross-sectional view, respectively.
Figure 3B:
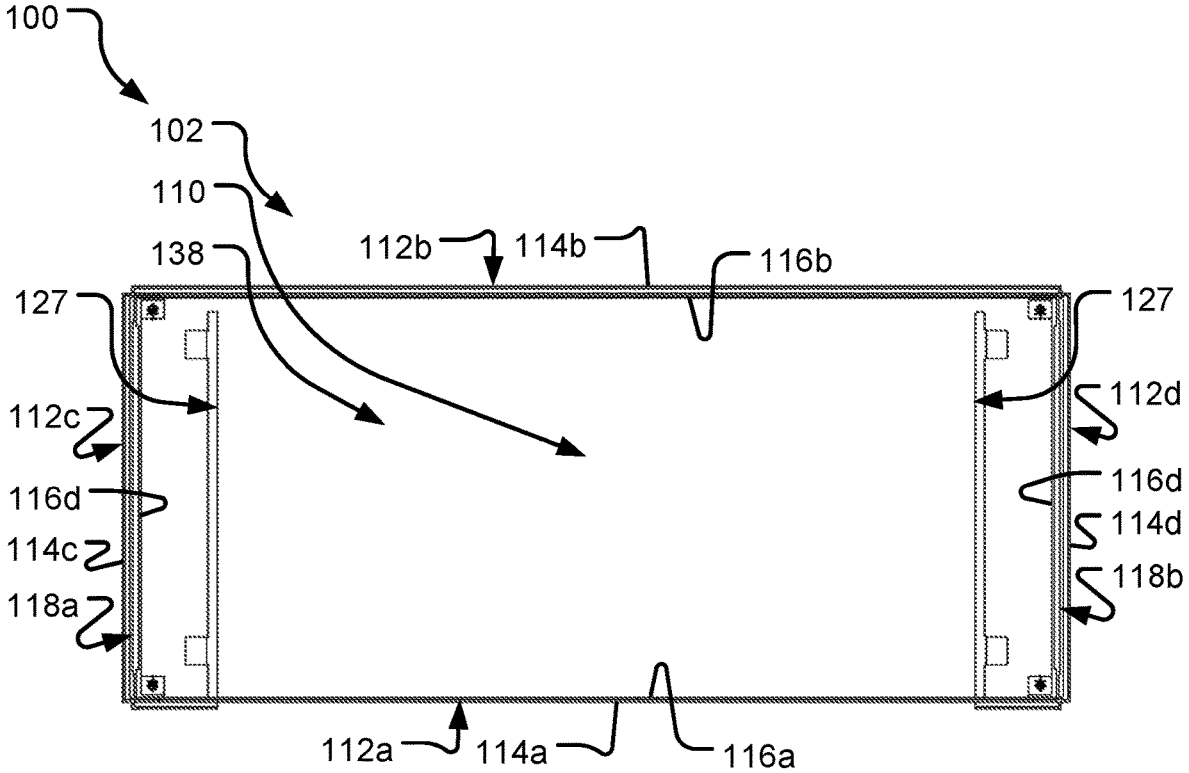
Figure 3C:
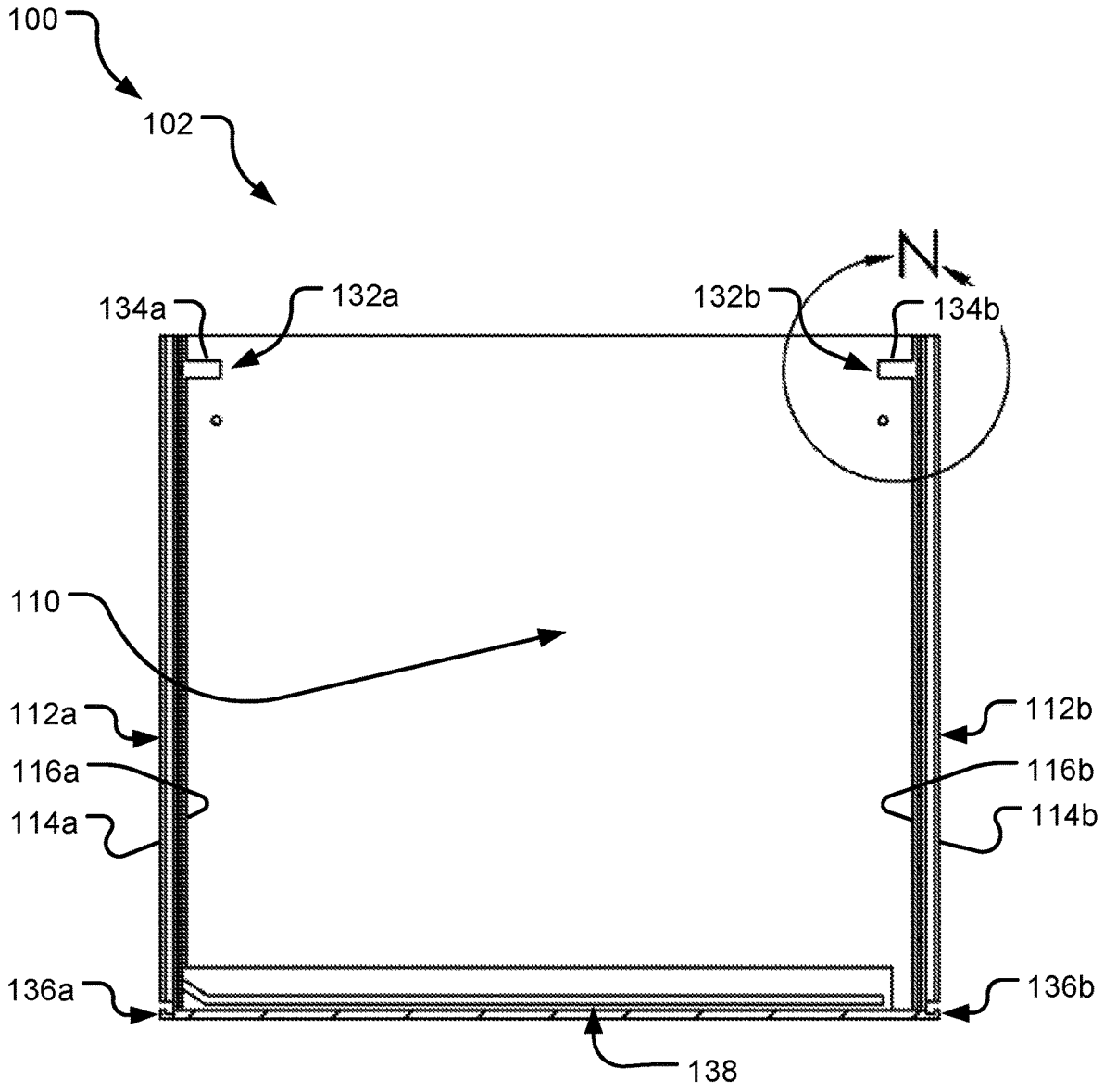

Turning to the structure 102, a structure 102 (e.g., base) can be included in the package-storing assembly 100, as illustrated in FIGS. 1A-1C and FIGS. 2A-2C. One example of the structure 102 is illustrated in FIGS. 3A-3C, which are a front-view, top-view, and cross-sectional view, respectively, of the structure 102. As previously discussed, the structure 102 can cooperate with the security screen 106 and/or the lid 108 to receive and securely store one or more packages.

The structure 102 can define, in whole or in part, a storage compartment 110, which can receive and securely store one or more packages. In other words, the storage compartment 110 is where the packages are stored after they are placed into the package-storing assembly 100. The storage compartment 110 can securely store packages for any length of time. For example, the storage compartment 110 can store packages for a short time (e.g., less than 24-hours), an intermediate time (e.g., greater than 24-hours and less than 1-month), or a long time (e.g., greater than 1-month). The structure 102 can be made of metal (e.g., aluminum, steel), polymer (e.g., plastic), wood, concrete, or a combination thereof.

The structure 102 can include one or more sidewalls 112 (e.g., 112*a*, 112*b*, 112*c*, 112*d*). Each of the one or more sidewalls 112 defines an outer surface 114 (e.g., 114*a*, 114*b*, 114*c*, 114*d*) and an inner surface 116 (e.g., 116*a*, 116*b*, 116*c*, 116*d*) opposite the outer surface 114. The inner surface 116 of the sidewalls 112 can define, in part, the storage compartment 110. The outer surface 114 of the sidewalls 112 can inhibit access to one or more packages within the storage compartment 110. In some instances, the inner surface 116 and/or outer surface 114 of each sidewall 112 can be planar.

In some instances, the structure 102 can have four sidewalls 112. For example, the structure 102 can include a front sidewall 112*a* and a rear sidewall 112*b* opposite the front sidewall 112*a*. The front sidewall 112*a* can be substantially parallel to the rear sidewall 112*b*. Similarly, the structure 102 can include a left sidewall 112*c* and a right sidewall 112*d* opposite the left sidewall 112*c*. The left sidewall 112*c* can be substantially parallel to the right sidewall 112*d*.

One of the sidewalls 112 can include a recess 113, which can be configured to fit a handle 174 of a security screen 106 when the security screen 106 is in its closed position. In some instances, the front sidewall 112*a* can include a recess 113. The recess 113 of the sidewall 112*a* can be aligned with the recess 152 of the guide 104.

The distance between the outer surface 114*c* of the left sidewall 112*c* and the outer surface 114*d* of the right sidewall 112*d* can define a length of the structure 102. In some examples, the length of the structure 102 can be between approximately 40-inches and 60-inches. For example, the length of the structure 102 can be between approximately 45-inches and 55-inches. For example, the length of the structure 102 can be between approximately 48-inches and 52-inches. For example, the length of the structure 102 can be approximately 50-inches. For example, the length of the structure 102 can be approximately 51-inches.

The distance between the outer surface 114*a* of the front sidewall 112*a* and the outer surface 114*b* of the rear sidewall 112*b* can define a width of the structure 102. In some examples, the width of the structure 102 can be between approximately 12-inches and 36-inches. For example, the width of the structure 102 can be between approximately 18-inches and 24-inches. For example, the width of the structure 102 can be approximately 21-inches. For example, the width of the structure 102 can be approximately 22-inches.

Figure 5A:
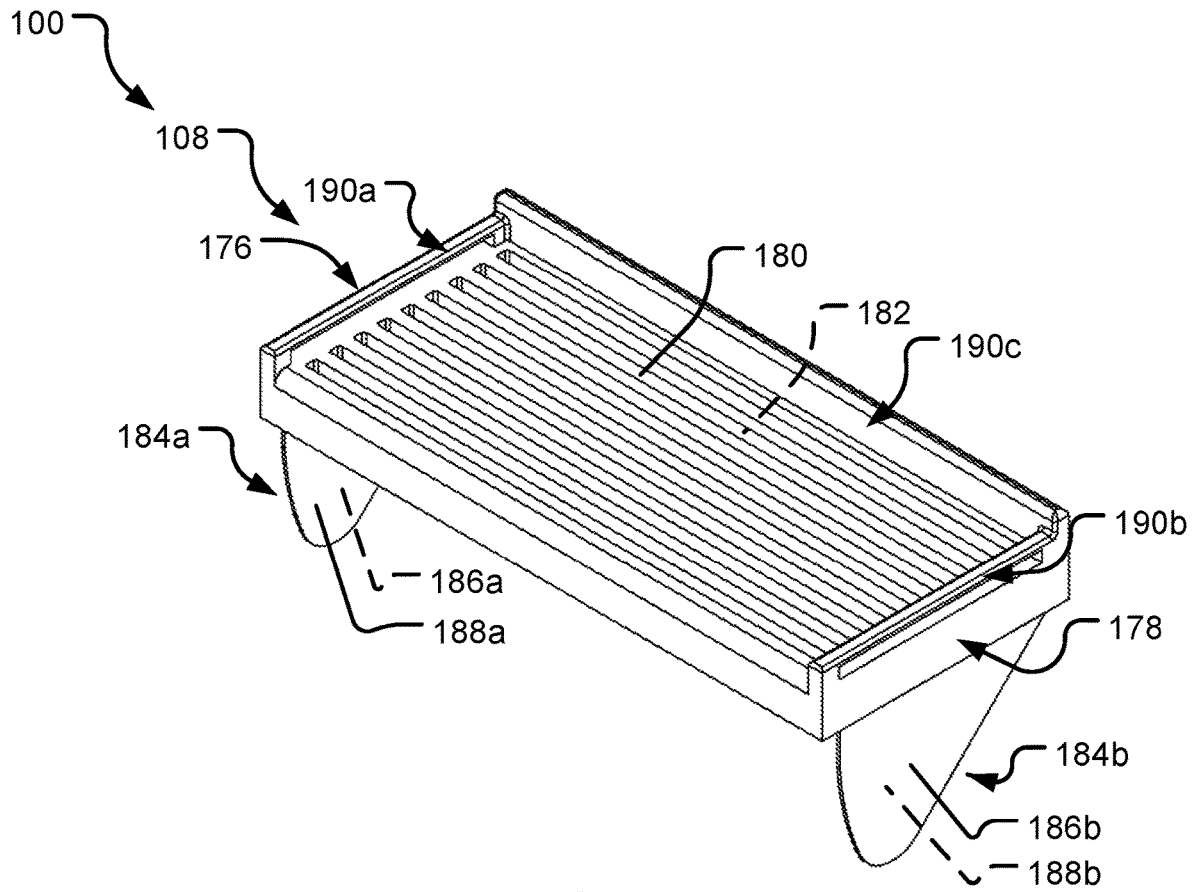
FIGS. 5A-5C illustrate one instance of a lid in a perspective view, front-view, and side-view, respectively.
Figure 5B:
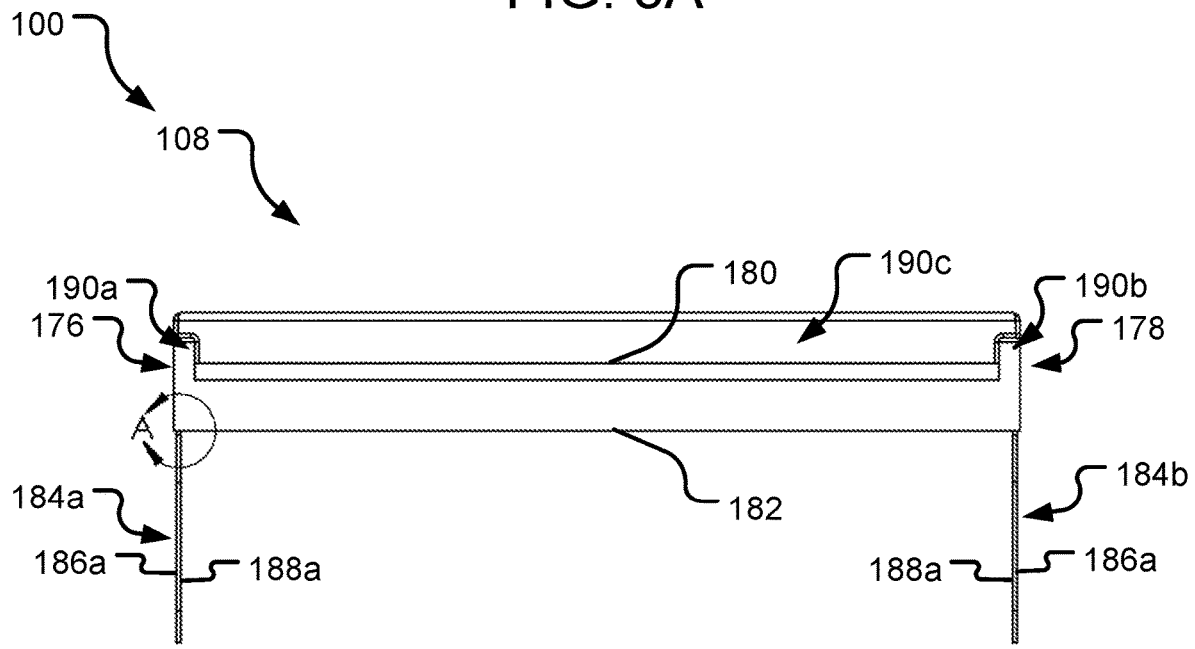
Figure 5C:
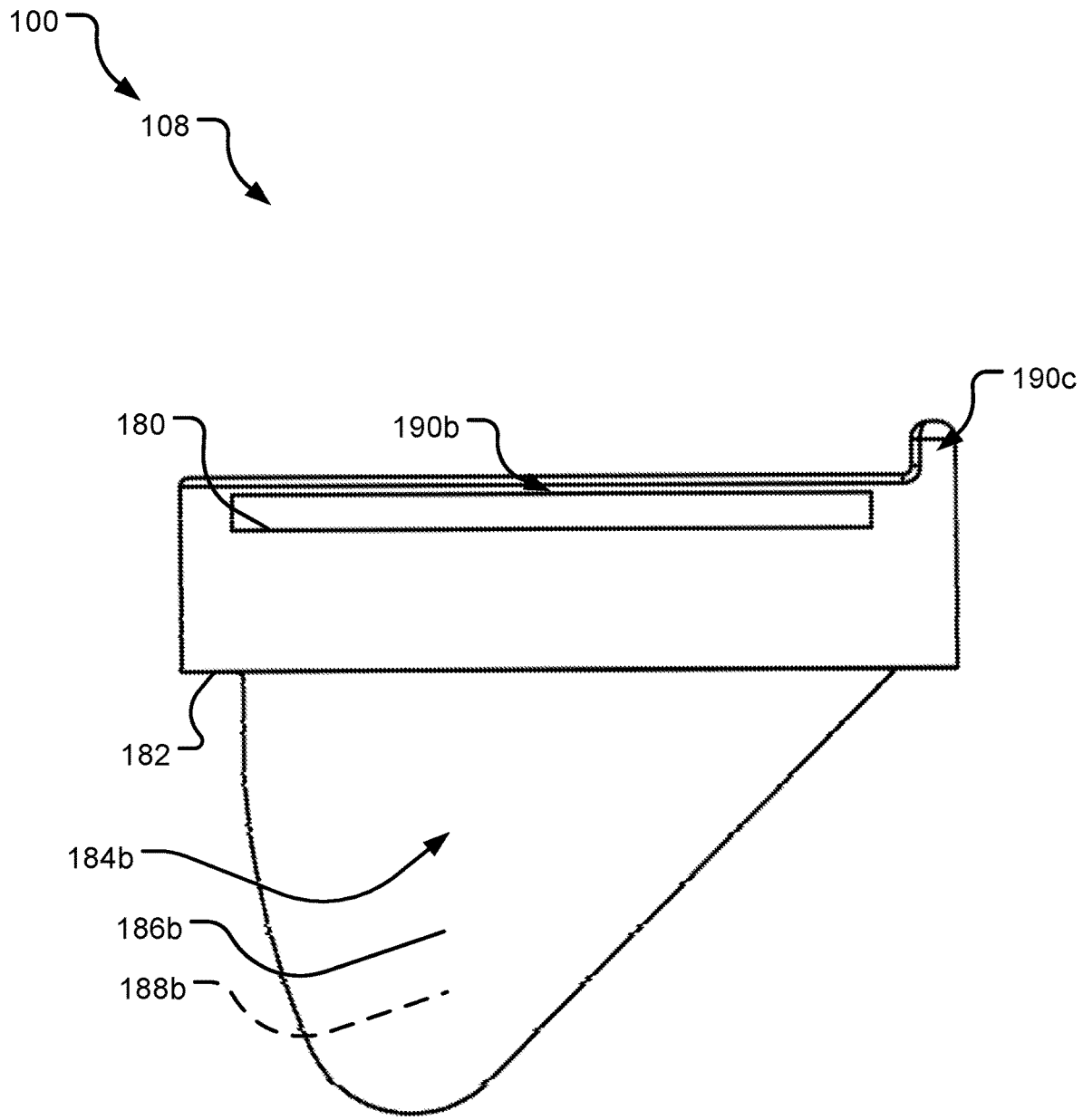

Continuing with the structure 102, a slot 118 (e.g., 118*a*, 118*b*) can be included in the one or more sidewalls 112. For example, as illustrated in FIG. 3B, the left sidewall 112*c* can include a slot 118*a* and the right sidewall 112*d* can include a slot 118*b*. The slots 118*a*, 118*b* (as illustrated in FIG. 3B) can be configured to receive fins 184 (e.g., 184*a*, 184*b*) of the lid 108 (as illustrated in FIGS. 5A-5C), such as when the lid 108 is in the closed position (as illustrated in FIGS. 2A-2C). In other words, the fins 184*a*, 184*b* of the lid 108 can be within the slots 118*a*, 118*b* of the structure 102 when the lid 108 is closed. A portion of the fins of the lid can be within the slots 118*a*, 118*b* when the lid 108 is open and/or when the lid is transitioning between the open position and closed position. When the lid 108 is open, the fins 184 can form a portion of a wall that blocks access to the storage compartment.

An opening 120 can extend through the one or more sidewalls 112 to provide access through the sidewall 112 to the storage compartment 110. For example, as illustrated in FIG. 3A, the front sidewall 112*a* can include an opening 120 that extends from the outer surface 114*a* to the inner surface 116*a* (e.g., through the front sidewall 112*a*). The opening 120 can be configured to accommodate an access door 122 (as illustrated in FIGS. 1A-1B and FIGS. 2A-2B).

An access door 122, as illustrated for example in FIGS. 1A-1B, FIGS. 2A-2B, and FIG. 6, can operably cover the opening 120 in the structure 102 to provide secure access to the storage compartment 110. In some instances, as illustrated in FIGS. 1A-1B and FIGS. 2A-2B, an access door 122 can operably cover the opening 120 that extends through the front sidewall 112*a*. The access door 122 can be operable to transition between a closed position and an open position. For example, FIGS. 1A-1B and FIGS. 2A-2B illustrate the access door 122 in the closed position.

Figure 6:
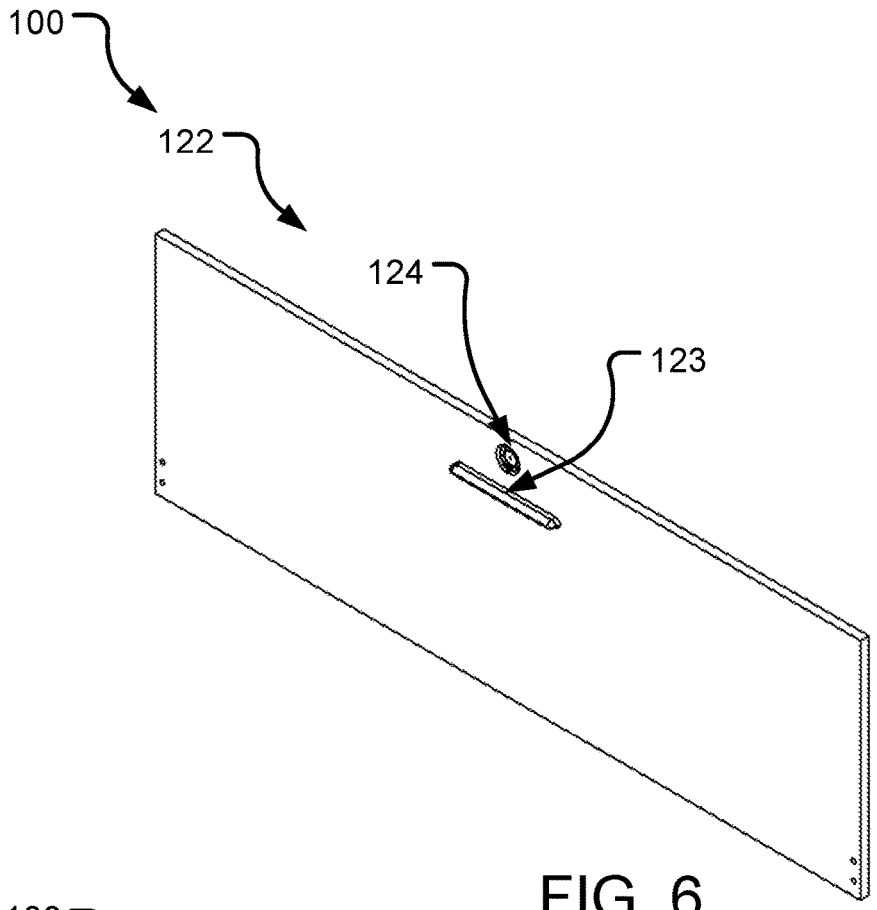
FIG. 6 illustrates one instance of an access door, which can operably cover an opening in the structure and provide authorized access.

In some instances, the access door 122 can include a handle 123, as illustrated for example in FIG. 6, which can be used to open and/or to close the access door 122 (e.g., transition the access door 122 between its open position and its closed position). The handle 123 can extend outward from the outer surface of the access door 122. The access door 122 can include a lock 124, which can secure the access door 122 in the closed position. In some instances, the lock 124 can be a keyed lock. In other instances (not shown in the figures), the lock 124 can be a keyless lock (e.g., smart lock, touchpad, or otherwise electronic lock). When the access door 122 is in the closed position and the lock 124 is engaged (i.e., locked), the access door 122 can inhibit access to the storage compartment 110 of the package-storing assembly 100 for an unauthorized person. In some instances, when the access door 122 is in the open position, the storage compartment 110 can be accessible through the opening 120. For example, an authorized user can unlock the lock 124 and open the access door 122 to retrieve one or more packages.

Figure 7:
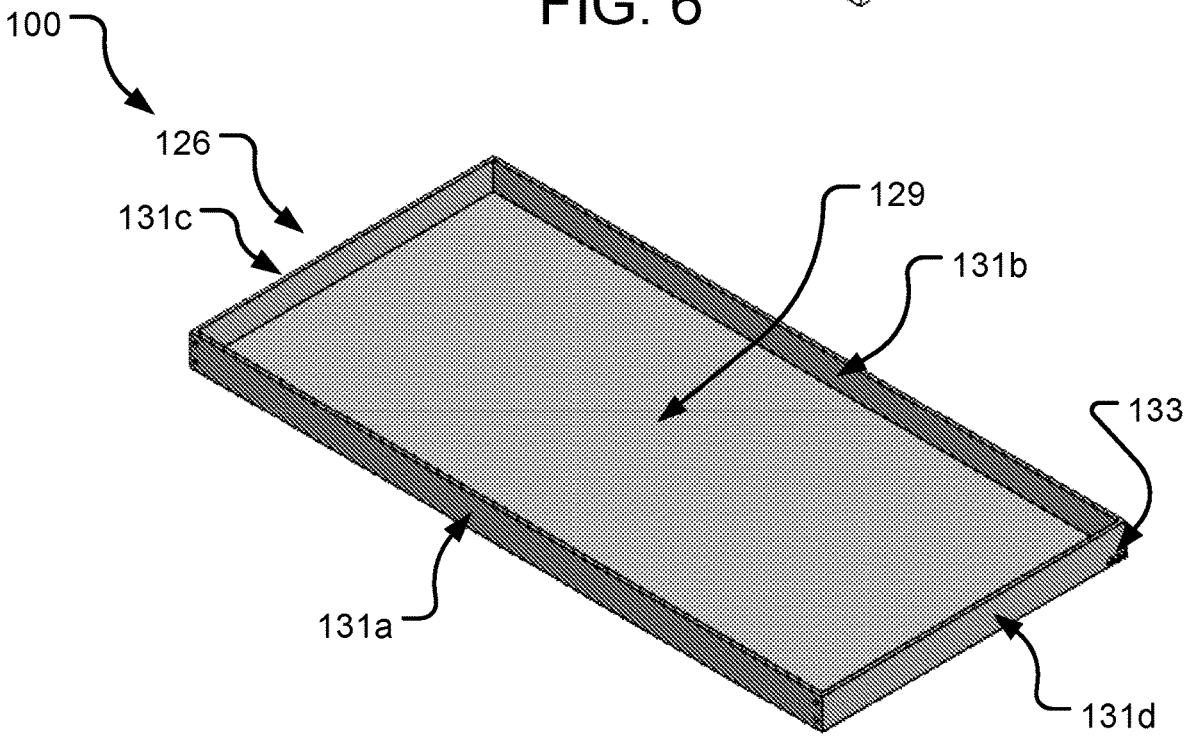
FIG. 7 illustrates one instance of a drawer, which can be used in conjunction with an access door.

In some instances, the access door 122 can include a drawer 126 (as illustrated in FIG. 7). The drawer 126 can include abase 129 and one or more sidewalls 131 (e.g., 131*a*, 131*b*, 131*c*, 131*d*). The inner surfaces of the base 129 and the one or more sidewalls 131 can define, in part, the storage compartment 110. The inner surfaces of the base 129 and one or more sidewalls 131 can receive and securely store one or more packages. The sidewalls 131 can be substantially perpendicular to the base 129 of the drawer 126.

For example, the inner surface of the access door 122 (e.g., opposite the surface having the handle 123, as illustrated in FIG. 6) can be coupled (e.g., bolted) to the outer surface of the front sidewall 131*a* of the drawer 126 (as illustrated in FIG. 7). The drawer 126 can slidably engage with the structure 102. In some instances, the drawer 126 can be withdrawn (e.g., away from the structure 102 to open) to unload a package. The drawer 126 can be pushed in (e.g., towards the structure 102 to close) to secure the drawer 126 in its closed position (e.g., by engaging the lock 124). For example, the drawer 126 (as illustrated in FIG. 7) can be slidably supported by one or more rails 127 (as illustrated in FIG. 3B). The left sidewall 131*c* and the right sidewall 131*d* of the drawer can include one or more bearings 133, which can slidably engage with the rails 127 of the structure 102. Together, the access door 122 and corresponding drawer 126 can slide towards and into the structure 102 (e.g., to transition to the closed position). Similarly, the access door 122 and corresponding drawer 126 can respectively slide away from and out the structure 102 (e.g., to transition to the open position).

In other instances, the access door 122 can be hingedly connected to the structure 102. In other words, the access door 122 can rotate about hinges to transition between its open position and its closed position.

Continuing with the structure 102, one or more apertures 128 can extend through the one or more sidewalls 112, as illustrated for example in FIG. 3C. The apertures 128 allow the structure 102 of the package storing assembly 100 to be bolted to a wall to prevent it from being carried away. For example, each aperture 128 can be configured to receive a fastener (e.g., bolt, screw) therethrough. In other words, each fastener can extend through the sidewall 112 (e.g., from the inner surface 116 through the outer surface 114) and couple (e.g., secure) the structure 102 to a vertical surface (e.g., wall). In some instances, as illustrated in FIG. 3A, two apertures 128 can extend through the rear sidewall 112*b* of the structure 102.

A spacer bar 130, as illustrated for example in FIG. 1C, can extend from the structure 102 at each aperture 128. Each spacer bar 130 can be configured to receive a fastener through a central opening of the spacer bar 130. In other words, each fastener can extend through the central opening of each spacer bar 130, in addition to extending through each aperture 128, to couple the structure 102 to a vertical surface. In some instances, two spacer bars 130 can extend from the rear sidewall 112*b* at each aperture 128 (e.g., the central opening of each spacer bar 130 can be in alignment with each respective aperture 128).

Continuing with the structure 102, a protrusion 132 (e.g., 132*a*, 132*b*), as illustrated for example in the cross-sectional view in FIG. 3C (which is a cross-sectional view taken along the section line drawn on FIG. 3A), can extend from the inner surface 116 of one or more sidewalls 112. Each protrusion 132 can define a planar surface 134 (e.g., 134*a*, 134*b*), which can support the guide 104 (as illustrated in FIG. 1A and FIGS. 4A-4E) with which the security screen 106 (as illustrated in FIGS. 1A-1C) can be slidably engaged. Each planar surface 134 can be substantially perpendicular to each respective sidewall 112. In some examples, a protrusion 132*a* can extend from the inner surface 116*a* of the front sidewall 112*a* and can define planar surface 134*a*. Similarly, a protrusion 132*b* can extend from the inner surface 116*b* of the rear sidewall 112*b* and can define planar surface 134*b*. Each planar surface 134*a*, 134*b* can support the guide.

A bracket 136 (e.g., 136*a*, 136*b*), as illustrated for example in the cross-sectional view in FIG. 3C, can extend from the outer surface 116 of one or more sidewalls 112. Each bracket 136 is configured to support a decorative finish material (e.g., wood). In some examples, a bracket 136*a* can extend from the outer surface 114*a* of the front sidewall 112*a* and a bracket 136*b* can extend from the outer surface 114*b* of the rear sidewall 112*b*. In one example, each bracket 136 can support a material (e.g., wood) that covers a portion of the sidewalls 112 constructed of a different material (e.g., metal).

The structure 102 can include a bottom wall 138, as illustrated for example in FIGS. 3A-3C. In some instances, the bottom wall 138 can be substantially perpendicular to the one or more sidewalls 112. The bottom wall 138 can define, in part, the storage compartment 110. For example, the bottom wall 138, in conjunction with the one or more sidewalls 112, can define the storage compartment 110. The bottom wall 138 can support one or more rails 127 (as illustrated in FIG. 3B), with which the drawer 126 (as illustrated in FIG. 7) can slidably engage, as previously discussed.

Figure 8:
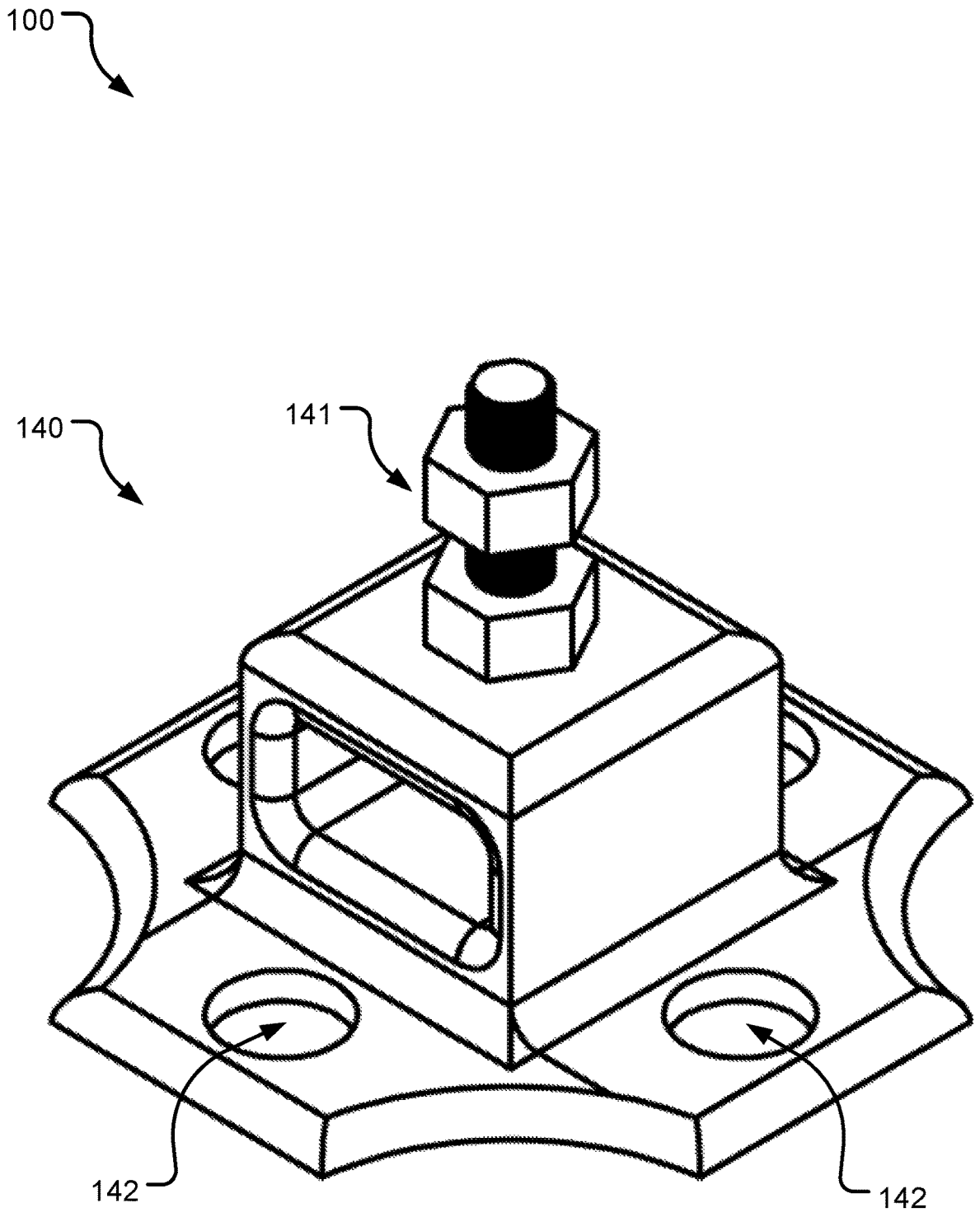
FIG. 8 illustrates one instance of an anchor foot.

One or more anchor feet 140 can extend from the bottom wall 138 and or sidewalls 112, as illustrated for example in FIGS. 1A-1C and FIGS. 2A-2C. The anchor feet 140 can be used to bolt the structure 102 of the package storage assembly 100 to the ground so that it cannot be carried away. In some instances, each of the anchor feet 140 can include hardware 141 (e.g., a bolt and one or more nuts) to removably couple the anchor foot 140 to the structure 102. Each of the anchor feet 140 can include at least one aperture 142, as illustrated for example in FIG. 8. Each aperture 142 can be configured to receive a fastener (e.g., bolt, screw) therethrough. For example, a fastener can extend through an aperture 142 of the anchor foot 140 to couple (e.g., secure) the structure 102 to a horizontal surface (e.g., ground). The horizontal surface can be, for example, a front porch (e.g., a concrete slab, decking).

Turning to the guide 104, a guide 104 can be included in the package-storing assembly 100, as illustrated in FIG. 1A and FIG. 2C. One example of the guide 104 is illustrated in FIGS. 4A-4E, which are a perspective view, front-view, top-view, cross-sectional view, and detailed cross-sectional view, respectively, of the guide 104. The guide 104 can guide the security screen 106 as the security screen 106 transitions between an open position (as illustrated in FIGS. 1A-1C) and a closed position (as illustrated in FIGS. 2A-2C). The guide 104 can define, in part, the storage compartment 110 and/or the staging compartment 143 (as illustrated in FIGS. 1A-1C).

The guide 104 can be positioned over an opening in the structure 102 (as illustrated in FIG. 1A and FIG. 2C), such as the opening at the top (e.g., opposite the bottom wall) of the one or more sidewalls 112. In this manner, the guide 104 can guide the security screen 106 to operably cover the opening in the structure 102.

The guide 104 can include a plate 144, which can define an outer surface 146 and an inner surface 148, as illustrated in FIGS. 4A-4E. In some instances, the outer surface 146 and/or inner surface 148 of the plate 144 can be planar. The distance between the outer surface 146 and inner surface 148 can define a thickness of the plate 144.

A slot 150 can be included in the plate 144. The slot 150 can extend through the thickness of the plate 144 and along a portion of the length of the plate 144. The slot 150 can be configured to guide the security screen 106 as it transitions between its closed position and its open position. Additionally, the plate 144 can include a recess 152 (e.g., in the outer surface 146). The recess 152 can be in communication with the slot 150 and can be configured to accommodate the handle 174 (as illustrated in FIGS. 1A-1C) of the security screen 106, such as when the security screen 106 is in the closed position. The recess 152 of the plate 144 can be aligned with the recess 113 in the structure 102.

The plate 144 can be coupled to the structure 102, as illustrated for example in FIG. 1A. In some instances, the inner surface 148 of the plate 144 (as illustrated in FIGS. 4A-4E) can contact the planar surfaces 134 of the protrusions 132 (as illustrated in FIG. 3C) in the structure 102. The plate 144 can include one or more apertures 154, which can extend through the thickness of the plate 144. Each aperture 154 can be configured to receive a fastener (e.g., bolt, screw) therethrough. For example, a fastener can extend through an aperture 154 of the plate 144 to couple (e.g., secure) the guide 104 to the structure.

A central opening 156 can extend through the thickness of the plate 144. The central opening 156 can be configured to receive packages therethrough. In some examples, the central opening 156 can be generally rectangular in shape.

Continuing with the guide 104, the guide 104 can include a track 158 as illustrated for example in FIGS. 4A-4E. The track 158 can define an outer surface 160 and an inner surface 162, as best illustrated in the cross-sectional view in FIG. 4D (which is a cross-sectional view taken along the section line drawn on FIG. 4C). In some instances, the outer surface 160 and/or inner surface 162 of the track 158 can be arcuate planar surfaces. The distance between the outer surface 160 and inner surface 162 can define a thickness of the track 158. The outer surface 160 can define, in part, the staging compartment 143 (as illustrated in FIGS. 1A-1C). The inner surface 162 can define, in part, the storage compartment 110 (as illustrated in FIGS. 1A-1C).

The guide 104 can include a pathway 164 (e.g., travel path) as illustrated for example in FIGS. 4A-4E. In some instances, the pathway 164 can be included between the outer surface 160 and the inner surface 162 of the track 158. The pathway 164 can be defined by one or more pathway surfaces 166 (e.g., 166*a*, 166*b*). In some instances, the one or more pathway surfaces 166 can each be an arcuate planar surface. For example, the one or more pathway surfaces 166 can each be a cylindrical surface. The pathway 164 can guide the security screen 106 (as illustrated in FIGS. 1A-1C) as the security screen 106 transitions between its closed position and its open position.

Figure 4A:
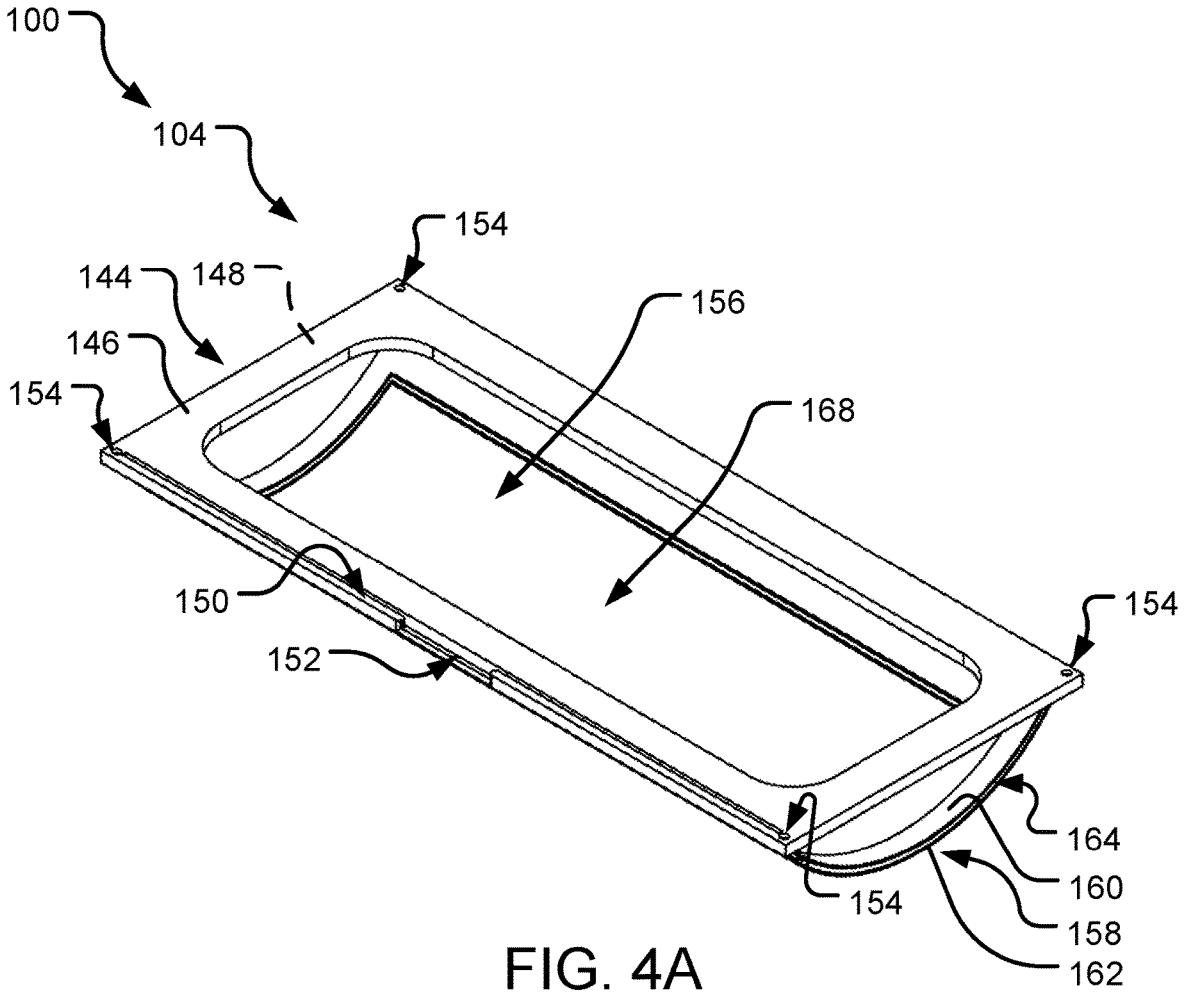
FIGS. 4A-4E illustrate one instance of a guide in a perspective view, front-view, top-view, cross-sectional view, and detailed cross-sectional view, respectively.
Figure 4B:
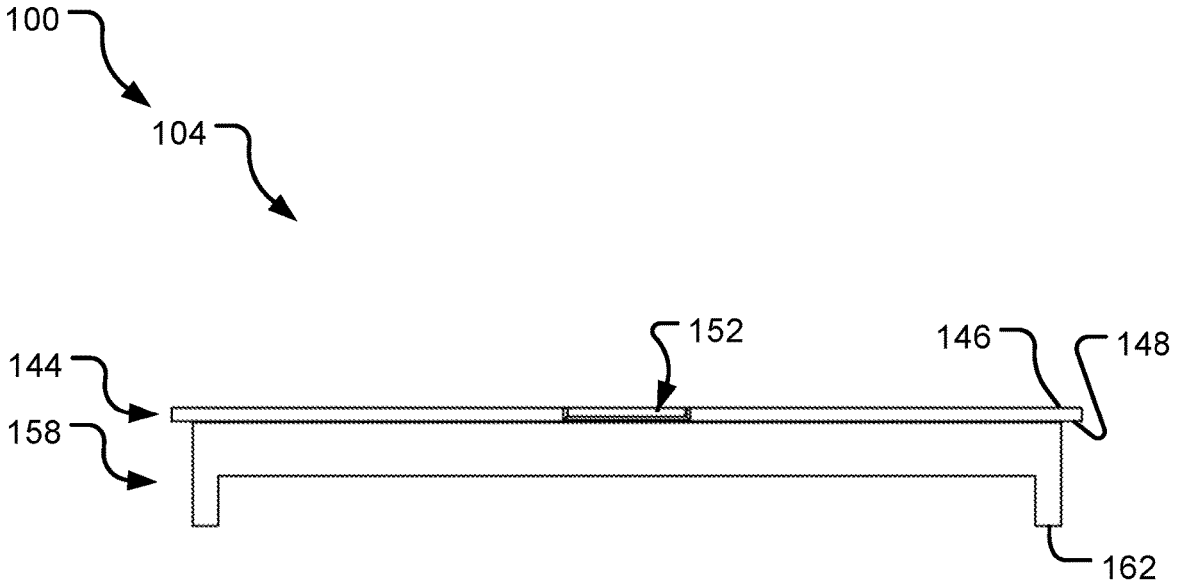
Figure 4C:
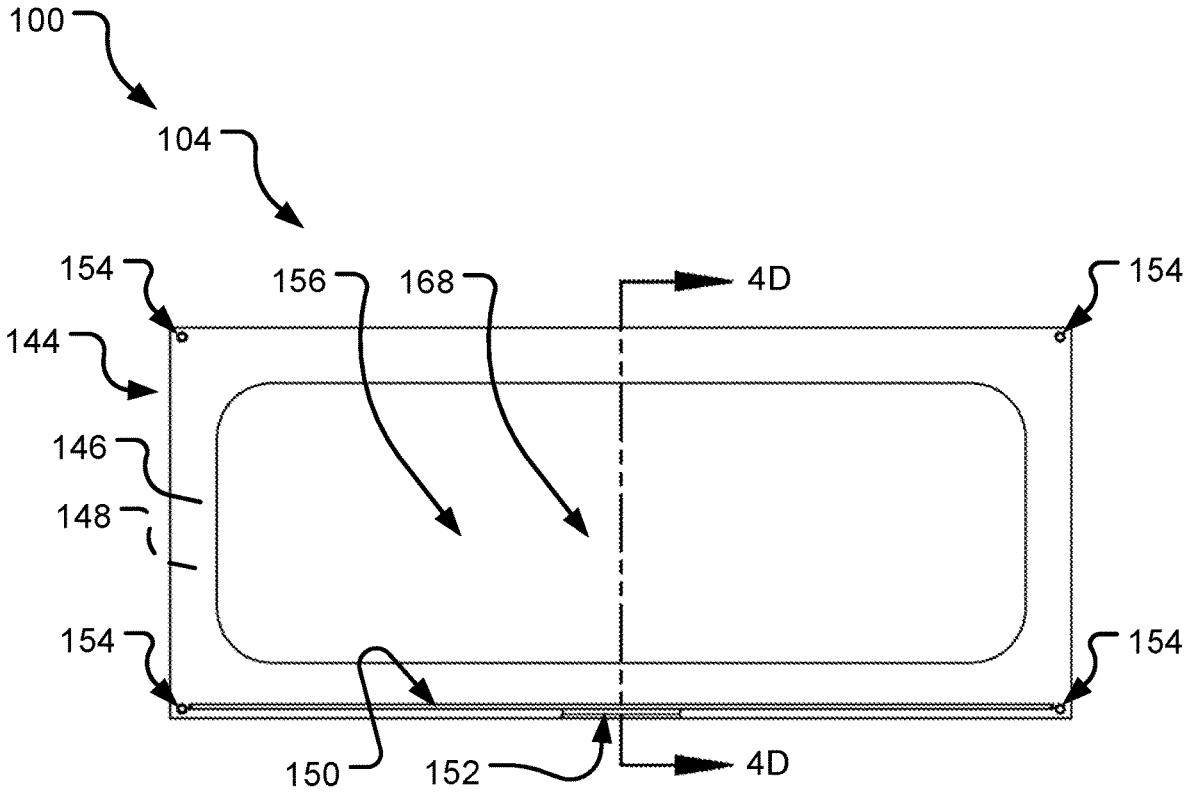
Figure 4D:
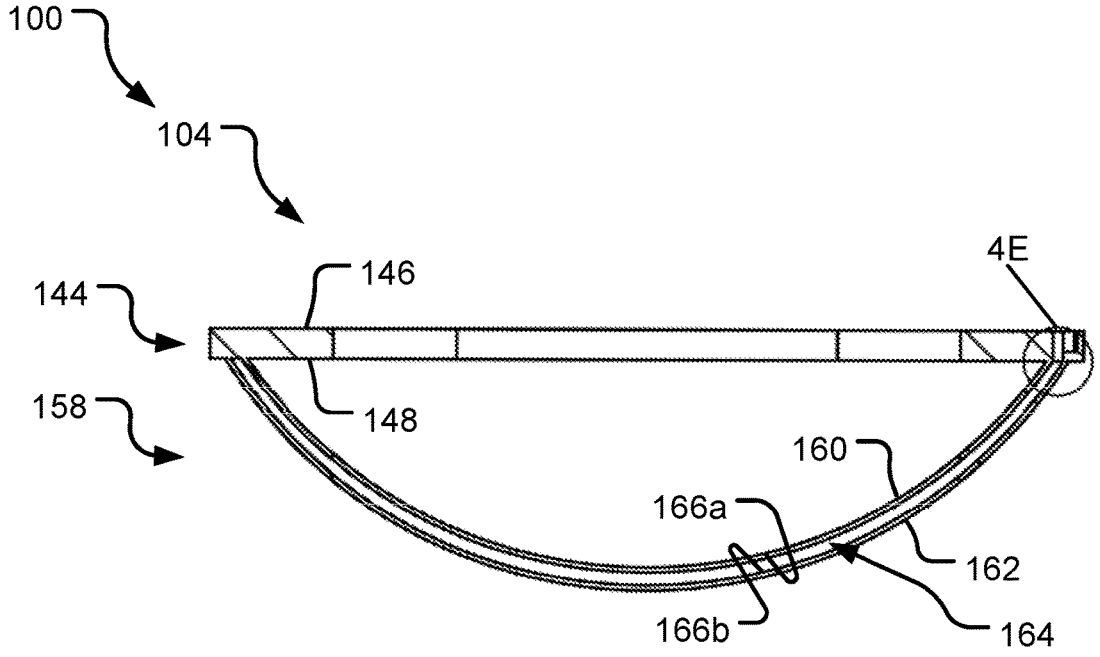
Figure 4E:
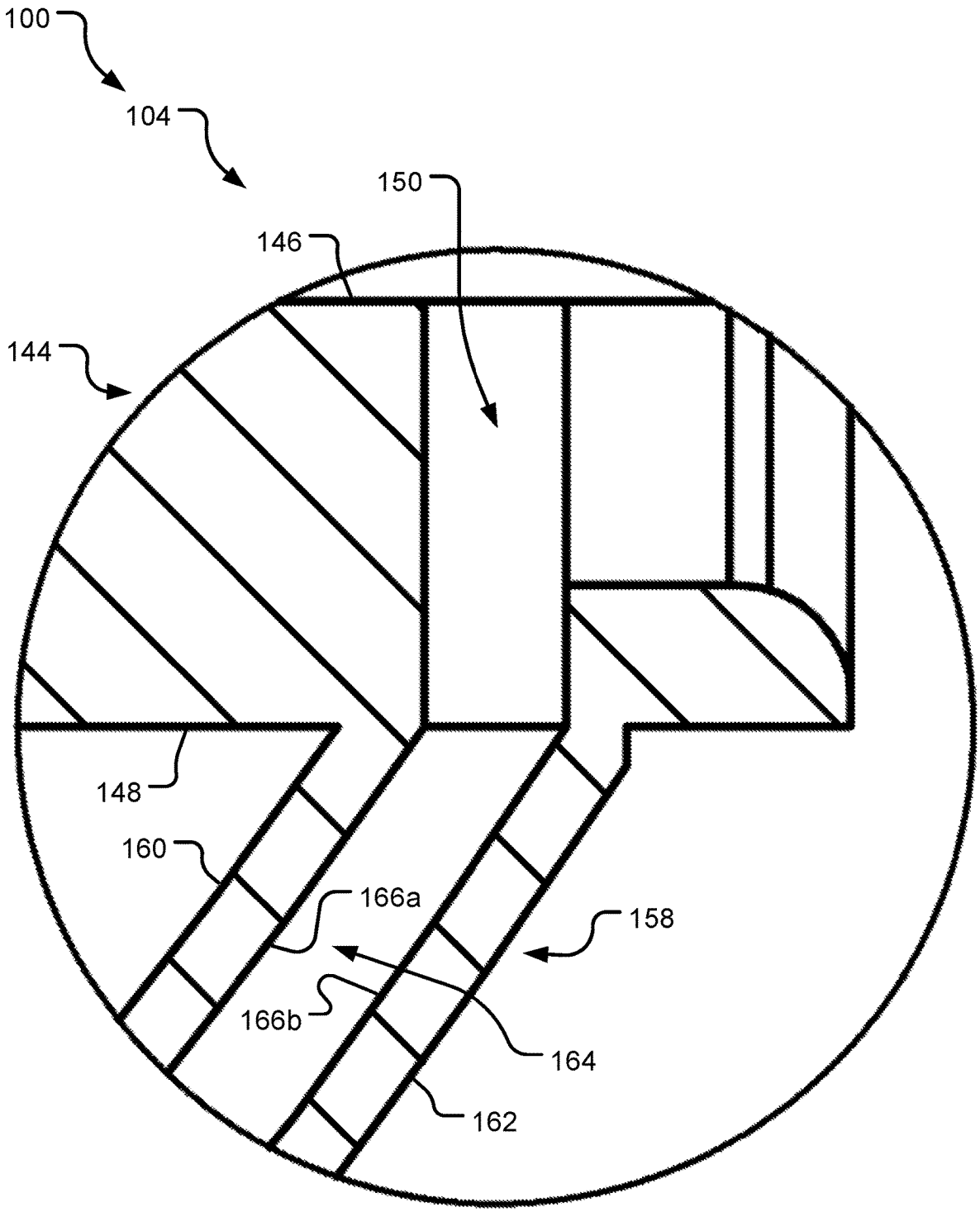

The pathway 164 can be in communication with the slot 150, as best illustrated in the detailed cross-sectional view in FIG. 4E (which is a cross-sectional view taken along the detail circle drawn on FIG. 4D). In this manner, the security screen 106 (as illustrated in FIGS. 1A-1C) can slidably engage with the slot 150 and/or pathway 164. In other words, the slot 150 and/or pathway 164 can guide the security screen 106 as it transitions between its closed position and its open position.

A central opening 168 can extend through the thickness of the track 158. The central opening 168 can be configured to receive packages therethrough. In some examples, the central opening 168 can be generally rectangular in shape. In some instances, the central opening 168 can be substantially aligned with the central opening 156 of the plate 144. In this manner, a package can be received through the central opening 156 of the plate 144 and then through the central opening 168 of the track 158.

Turning to the security screen 106, a security screen 106 can be included in the package-storing assembly 100, as illustrated in FIGS. 1A-1C and FIG. 2C. The security screen 106 can be operable to transition between an open position (as illustrated in FIGS. 1A-1C) and a closed position (as illustrated in FIGS. 2A-2C). In its various positions, the security screen 106 can cooperate with the structure 102 and/or the lid 108 to receive and securely store one or more packages.

The security screen 106 can slidably engage with the guide 104. In some instances, the security screen 106 can slidably engage with the one or more pathway surfaces 166 (as illustrated in FIG. 4D) of the guide 104. For example, the security screen 106 can slide along the one or more pathway surfaces 166, which, as previously discussed, can each be an arcuate planar surface. The security screen 106 can be made out of a semi-flexible material. For example, the security screen 106 can be fabricated of polymer (e.g., plastic), sheet metal, laminate, wood, various combinations thereof, and/or other materials.

The security screen 106 can define a first surface 170 and a second surface 172 opposite the first surface 170, as best illustrated in the side-view in FIG. 1C. The distance between the first surface 170 and the second surface 172 can define a thickness of the security screen 106. The first surface 170 can define, in part, the staging compartment 143. Before the storage compartment 110 receives one or more packages, the staging compartment 143 can receive the packages. For example, the first surface 170 of the security screen 106 can support the packages when the security screen is in its closed position.

The security screen 106 can include a handle 174, which can be used to open and/or to close the security screen (e.g., transition the security screen 106 between its open position and its closed position). In some instances, the handle 174 can extend from the second surface 172 of the security screen 106. The handle 174 can be configured to fit within the recess 113 of the structure 102 and/or the recess 152 of the guide 104 (as illustrated in FIGS. 4A-4C).

The security screen 106 can be operable to transition between a closed position (e.g., lowered as illustrated in FIGS. 2A-2C) and an opened position (e.g., raised as illustrated in FIGS. 1A-1C). In some instances, the security screen 106 can be slidably engaged with the one or more pathway surfaces 166 of the guide 104 (as illustrated in FIGS. 4A-4E). In this manner, the security screen 106 can be slidably closed (e.g., the security screen 106 can transition from its open position to its closed position). Additionally, the security screen 106 can be slidably opened (e.g., the security screen 106 can transition from its closed position to its open position).

In its closed position, as illustrated for example in FIGS. 2A-2C, the security screen 106 blocks access to the storage compartment 110 of the package-storing assembly 100. For example, the security screen 106 (as illustrated in FIG. 2C) cooperates with the guide 104 (as illustrated in FIGS. 4A-4E) to inhibit access to the storage compartment 110. In some instances, in its closed position, the security screen 106 can inhibit access through the central opening 168 of the track 158 of the guide 104. For example, the security screen 106 can cooperate with the guide 104 to inhibit access through the central opening 168. In some instances, in its closed position, the security screen 106 can cover, in whole or in part, the central opening 168 of the track 158 of the guide 104. In some instances, the security screen 106 can be configured to automatically close (e.g., retract) in the absence of applied force. In other words, absent applied force to open the security screen 106, the security screen 106 automatically transitions to its closed position.

In some instances, the security screen 106 forms an arcuate planar surface when the security screen 106 is in its closed position. For example, when the one or more pathway surface 166 of the guide 104 (as illustrated in FIGS. 4A-4E) are arcuate planar surfaces, the security screen 106 can form one or more corresponding arcuate planar surface when the security screen 106 is closed. For example, the first surface 170 and/or second surface 172 of the security screen 106 can form an arcuate planar surface. When a package is placed on the security screen 106, the arcuate planar surface (e.g., first surface 170 of the security screen 106) can cause the package to center within the guide 104, which is positioned over the opening of the structure 102. In other words, gravitational forces cause the package to slide so it is oriented along a centerline of the security screen 106.

To drop a package placed onto the security screen 106 into the storage compartment 110 for safe keeping, the security screen 106 can be opened. For example, FIGS. 1A-1C illustrate the security screen 106 in its open position. Opening the security screen 106 uncovers the central opening 168 of the guide 104 (as illustrated in FIGS. 4A-4E) so that a package drops into the storage compartment 110. In other words, when the security screen 106 is opened (e.g., transitions to its open position), the storage compartment 110 receives the package. In some instances, when the security screen 106 is opened, the package drops through the central opening 168 of the track 158 of the guide 104. In other words, when the security screen 106 is opened, the security screen 106 can uncover, in whole or in part, the central opening 168.

In its open position, the security screen 106 inhibits access to the storage compartment 110 of the package-storing assembly 100. For example, the security screen 106 (as illustrated in FIG. 2C) cooperates with the lid 108 (as illustrated in FIGS. 5A-5C) to inhibit access to the central openings 156, 168 of the guide 104 (as illustrated in FIGS. 4A-4E) and into the storage compartment 110. When the security screen 106 is opened, the security screen 106 forms a barrier that blocks access to the storage compartment 110. In some examples, the security screen 106 extends to the lid 108 and/or aligns with the fins 184 of the lid to form the barrier. In some instances, in its open position, the security screen 106 inhibits access to the central opening 168 of the track 158 of the guide 104. For example, the security screen 106 can cooperate with the lid 108 to inhibit access to the central opening 168. In some instances, in its open position, the security screen 106 can inhibit access to the staging compartment 143 of the package-storing assembly 100. For example, the security screen 106 can cooperate with the lid 108 to inhibit access to the staging compartment 143.

Turning to the lid 108, a lid 108 can be included in the package-storing assembly 100, as illustrated in FIGS. 1A-1C and FIGS. 2A-2C. The lid 108 can be operable to transition between an open position (as illustrated in FIGS. 1A-1C) and a closed position (as illustrated in FIGS. 2A-2C). One example of the lid 108 is illustrated in FIGS. 5A-5C, which are a perspective view, front-view, and side-view, respectively, of the lid 108. In its various positions, the lid 108 can cooperate with the security screen 106 and/or the structure 102 to receive and securely store one or more packages.

The lid 108 can have a first end 176 and a second end 178 opposite the first end 176, as illustrated in FIGS. 5A-5C. The distance between the first end 176 and the second end 178 can define a length of the lid 108. The length of the lid 108 can be substantially the same as the length of the structure 102 (as illustrated in FIGS. 1A-1C and FIGS. 2A-2C). Similarly, the width of the lid 108 can be substantially the same as the width of the structure 102.

The lid 108 can define an outer surface 180 and an inner surface 182 opposite the outer surface 180. In some instances, the outer surface 180 and/or inner surface 182 can be planar. The distance between the outer surface 180 and the inner surface 182 can define a thickness of the lid 108. In some instances, the thickness of the lid 108 can be between approximately 3-inches and 7-inches. For example, the thickness of the lid 108 can be between approximately 5-inches and 6-inches. For example, the thickness of the lid 108 can be approximately 5.5-inches.

The outer surface 180 of the lid 108 can inhibit access to the storage compartment 110 of the package-storing assembly 100. In some instances, the outer surface 180 of the lid 108 can be substantially parallel to a horizontal plane when the lid 108 is in its closed position. In some instances, the outer surface 180 of the lid 108 can define a bench seat. In some examples, the inner surface 182 of the lid 108 can define, in part, the staging compartment 143 of the package-storing assembly 100.

Continuing with the lid 108, the lid 108 can include one or more fins 184 (e.g., 184*a*, 184*b*) that extend from the lid 108. Each fin 184 can define an outer surface 186 (e.g., 186*a*, 186*b*) and an inner surface 188 (e.g., 188*a*, 188*b*) opposite the outer surface 186. The outer surface 186 of the one or more fins 184 can inhibit access to the storage compartment 110. The inner surface 188 of the one or more fins 184 can define, in part, the staging compartment 143 of the package-storing assembly 100. In some instances, the outer surface 186 and/or inner surface 188 can be planar. The distance between the outer surface 186 and inner surface 188 can define a thickness of the fin 184. In some examples, the thickness of the fin 184 can be between approximately 0.1-inch and 0.6-inch. For example, the thickness of the fin 184 can be between 0.4-inch and 0.6-inch. For example, the thickness of the fin 184 can be approximately 0.5-inch. For example, the thickness of the fin 184 can be between 0.15-inch and 0.35-inch. For example, the thickness of the fin 184 can be approximately 0.25-inch.

In some instances, a first fin 184*a* extends from the inner surface 182 of the lid 108 at the first end 176 and a second fin 184*b* extends from the inner surface 182 of the lid 108 at the second end 178. The first fin 184*a* and the second fin 184*b* (as illustrated in FIGS. 5A-5C) can be configured to fit into the respective slots 118*a*, 118*b* of the structure 102 (as illustrated in FIG. 3B) when the lid 108 is in its closed position (as illustrated in FIGS. 2A-2C). A portion of each of the fins 184*a*, 184*b* can be configured to be within each respective slot when the lid 108 is in its open position and/or when the lid 108 is transitioning between its closed position and its open position.

The lid 108 can include one or more raised edges 190 (e.g., 190*a*, 190*b*, 190*c*). In some instances, a raised edge 190*a* extends from the outer surface 180 of the lid 108 at the first end 177 and a raised edge 190*b* extends from the outer surface 180 of the lid 108 at the second end 178. Similarly, a raised edge 190*c* extends from the outer surface 180 of the lid 108 at the rear of the lid 108.

The lid 108 is operable to transition between a closed position (e.g., lowered) and an open position (e.g., raised). In some instances, the lid 108 can be hingedly connected to the structure 102. For example, the lid 108 can be hingedly connected to the rear sidewall 112*b* of the structure 102. In this manner, the lid 108 can be hingedly closed (e.g., the lid 108 can transition from its open position to its closed position). Similarly, the lid 108 can be hingedly opened (e.g., the lid 108 can transition from its closed position to its open position).

The lid 108 can be closed, as illustrated for example in FIGS. 2A-2C. In its closed position, the lid 108 (e.g., outer surface 180 of the lid 108) can inhibit access to the storage compartment 110 of the package-storing assembly 100. For example, the lid 108 can inhibit access to the storage compartment 110. In some instances, in its closed position, the lid 108 can inhibit access to the security screen 106 (e.g., first surface 170 of the security screen 106). For example, in its closed position, the lid 108 can cover, in whole or in part, the security screen 106. In some instances, the lid 108 can be configured to automatically close in the absence of applied force. In other words, absent applied force to open the lid 108, the lid 108 automatically transitions to its closed position. In some examples, the outer surface 180 of the lid 108 can be a bench seat when the lid 108 is closed.

The lid 108 can be opened, as illustrated for example in FIGS. 1A-1C. In its open position, with the security screen 106 is in its closed position, the lid 108 can provide access to the staging compartment 143. For example, when the lid 108 is in its open position and the security screen 106 is in its closed position, one or more packages can be placed in the staging compartment 143 (e.g., on the first surface 170 of the security screen 106).

In its open position, with the security screen 106 also in its open position, the lid 108 inhibits access to the storage compartment 110 of the package-storing assembly 100. In some instance, the outer surface 180 of the lid 108 and/or outer surface 186 of the one or more fins 184 cooperates with the security screen 106 to inhibit access to the storage compartment 110. In some instances, in its open position, with the security screen 106 in its open position, the lid 108 cooperates with the security screen 106 to inhibit access to the central opening 168 of the guide 104 (as illustrated in FIGS. 4A-4E) and into the storage compartment 110. In some instances, in its open position, with the security screen 106 in its open position, the lid 108 cooperates with the security screen 106 to inhibit access to the staging compartment 143. For example, in its open position the lid 108, in conjunction with the security screen 106 in its open position, can form a top wall over the staging compartment 143 to inhibit access to the staging compartment 143. Additionally, the fins 184 of the lid 108, in conjunction with the security screen 106 in its open position, can form a sidewall around the staging compartment 143 to inhibit access to the staging compartment 143.

In some instances, when the lid 108 is open and the security screen 106 is transitioned to its open position, the security screen 106 can extend to the inner surface 182 of the lid 108. The security screen 106 and the lid 108 can form a top wall, which defines barrier that inhibits access to the storage compartment 110. In some instances, when the lid 108 is open and the security screen 106 is transitioned to its open position, the security screen 106 can align with fin 184*a* and fin 184*b*. The security screen 106 and fins 184 can form a sidewall, which defines a barrier that inhibits access to the storage compartment 110.

As described above, the package-storing assembly 100, as illustrated for example in FIGS. 1A-1C and FIGS. 2A-2C, can receive one or more packages, securely store the packages, and allow retrieval of the packages. In some instances, the security screen 106 and the lid 108 can both be in the closed position with or without a package in the storage compartment 110.

The package-storing assembly 100 receives one or more packages, such as when a delivery person delivers a package. For example, the lid 108 can be transitioned (e.g., raised) to its open position. Opening the lid 108 positions the fins 184 to create a barrier, in conjunction with the security screen 106 when the security screen 106 is opened, and also provides access to the staging compartment 143. With the security screen 106 closed, which blocks access to the storage compartment 110 and any package therein, the package can be placed into the staging compartment 143. Specifically, the package can be placed on the first surface 170 of the security screen 106.

The security screen 106 is then transitioned (e.g., raised) to its open position, causing the package to drop into the storage compartment 110 of the package-storing assembly 100. Opening the security screen 106 also creates a barrier, which prevents the delivery person from reaching into the storage compartment 110 to remove a package therein. When the security screen 106 is open, the security screen 106 and lid 108 create walls around the staging compartment 143, thereby blocking access. When the lid 108 is in its open position and the security screen 106 is in its open position, the lid 108 and/or fins 184 of the lid 108 can cooperate with the security screen 106 to inhibit access to the staging compartment 143.

The one or more packages are securely stored in the storage compartment 110 of the package-storing assembly 100. For example, the security screen 106 can be transitioned (e.g., lowered) to its closed position. When the lid 108 is in its open position and the security screen 106 is in its closed position, the security screen 106 can block access to the storage compartment 110, which contains the packages. The lid 108 can be transitioned (e.g., lowered) to its closed position.

The one or more packages can be retrieved from the package-storing assembly 100 by an authorized user. In some examples, the lock 124 of the access door 122 can be unlocked by the authorized user. The access door 122 can be transitioned to its open position. The one or more packages can be retrieved from the storage compartment 110 of the package-storing assembly 100. In some instances, a drawer 126 that contains the one or more packages can be slid outward from the structure 102 (e.g., opening 120), the one or more packages can be retrieved from the drawer 126, and the drawer 126 can be slid inward into the structure 102. The access door 122 can be transitioned to its closed position. The access door 122 can be locked.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A package-storing assembly comprising:

an arcuate planar surface of a security screen positioned adjacent an opening of a structure, the arcuate planar surface of the security screen slidably engaged with a guide having an opening therethrough, the security screen supported by the guide to transition between a closed position and an open position, wherein the security screen inhibits access through the opening of the guide and the opening of the structure in the closed position, and cooperates with a lid of the structure to inhibit access to the opening of the structure when in the open position, and when the security screen is in the closed position the security screen covers the opening of the guide and the opening of the structure, wherein transitioning the security screen from the closed position to the open position uncovers the opening of the guide and the opening of the structure such that a package moves from a staging compartment outside of the structure to a storage compartment within the structure, wherein the staging compartment is defined by an inner surface of the lid and a first surface of the security screen when the security screen in the closed position, wherein the package is placed in the staging compartment when the security screen is in the closed position.

2. The package-storing assembly as recited in claim 1, wherein the security screen extends to the lid to form a top wall over the staging compartment in the open position, wherein the top wall inhibits access to the staging compartment.

3. The package-storing assembly as recited in claim 1, wherein the security screen aligns with fins of the lid to form sidewalls around the staging compartment in the open position, the sidewalls inhibit access to the staging compartment.

4. The package-storing assembly as recited in claim 1, wherein the lid defines an outer surface, wherein the outer surface is substantially parallel to a horizontal plane when the lid is in a closed position, wherein the outer surface of the lid defines a bench seat when the lid is in the closed position.

5. The package-storing assembly as recited in claim 1, further comprising the guide having two arcuate planar surfaces forming a track therebetween, wherein the security screen is slidably engaged with the track.

6. The package-storing assembly as recited in claim 1, wherein the structure has four sidewalls and a bottom wall, wherein four or more feet are coupled to the bottom wall, wherein at least one of the four or more feet contains an aperture configured to receive a connector therethrough to secure the structure to a horizontal surface.

7. The package-storing assembly as recited in claim 1, wherein an access door is positioned over a second opening in the structure, the access door operable to transition between a closed position and an open position, wherein the access door inhibits access to the storage compartment when the access door is in the closed position, wherein the access door allows access to the storage compartment when the access door is in the open position, wherein the access door comprises a lock, wherein the lock secures the access door in the closed position when the lock is engaged.

8. A package-storing assembly comprising: an arcuate planar surface of a security screen positioned adjacent an opening of a structure, the arcuate planar surface of the security screen slidably engaged with a guide having an opening therethrough, the security screen supported by the guide to transition between a closed position and an open position, wherein the security screen inhibits access through the opening of the guide and the opening of the structure in the closed position, and cooperates with a lid of the structure to inhibit access to the opening of the structure when in the open position, and when the security screen is in the closed position the security screen covers the opening of the guide and the opening of the structure, wherein transitioning the security screen from the closed position to the open position uncovers the opening of the guide and the opening of the structure such that a package moves from a staging compartment outside of the structure to a storage compartment within the structure, wherein the storage compartment is defined by an inner surface of the structure and a second surface of the security screen when the security screen is in the closed position, wherein the storage compartment receives the package from the staging compartment such that the package is securely stored within the storage compartment.

9. A package-storing assembly comprising: an arcuate planar surface of a security screen positioned adjacent an opening of a structure, the arcuate planar surface of the security screen slidably engaged with a guide having an opening therethrough, the security screen supported by the guide to transition between a closed position and an open position, wherein the security screen inhibits access through the opening of the guide and the opening of the structure in the closed position, and cooperates with a lid of the structure to inhibit access to the opening of the structure when in the open position, wherein the lid has a first end and a second end and defines an inner surface, wherein a first fin extends from the inner surface at the first end of the lid and a second fin extends from the inner surface at the second end of the lid, wherein when the security screen is in the open position and the lid is in an open position, the security screen aligns with the first fin and the second fin such that access to the opening of the structure is inhibited.

10. The package-storing assembly as recited in claim 9, wherein the security screen extends to the inner surface of the lid such that access to the opening of the structure is inhibited in the open position.

11. The package-storing assembly as recited in claim 9, wherein the lid is operable to transition between a closed position and the open position, wherein when the lid is in the closed position the first fin and the second fin are positioned within the structure, wherein the lid inhibits access to the opening of the structure when the lid is in the closed position.

12. The package-storing assembly as recited in claim 11, wherein when the lid is in the open position and the security screen is in the open position the security screen aligns with the first fin and the second fin to form sidewalls around the opening of the structure, wherein the sidewalls inhibit access to the opening when the lid is in the open position and the security screen is in the open position.

13. The package-storing assembly as recited in claim 11, wherein when the lid is in the open position and the security screen is in the open position, the security screen extends to the lid to form a top wall over the opening of the structure, wherein the top wall inhibits access to the opening when the lid is in the open position and the security screen is in the open position.

14. The package-storing assembly as recited in claim 11, wherein when the lid is in the open position and the security screen is in the closed position the inner surface of the lid, the first fin, the second fin, and an outer surface of the security screen define a staging compartment, wherein a package is placed in the staging compartment.

15. The package-storing assembly as recited in claim 14, wherein when the security screen is transitioned from the closed position to the open position, the package drops from the staging compartment into a storage compartment, wherein the storage compartment is defined by an inner surface of the structure.

16. The package-storing assembly as recited in claim 15, wherein the lid and the security screen inhibit access to the package within the storage compartment.

17. A package-storing device comprising:

a body having at least four sidewalls;

a lid hingedly connected to the body, the lid having a first end and a second end, the lid defining an outer surface and an inner surface, wherein the lid is operable to transition from a closed position to an open position;

a first fin extending from the inner surface at the first end of the lid and a second fin extending from the inner surface at the second end of the lid;

a guide defining an outer surface and an inner surface and having a central opening therethrough;

a security screen defining a first surface and a second surface, the security screen slidably engaged with the guide to transition from a closed position to an open position; and an access door through one of the at least four sidewalls, the access door operable to move between an open position and a closed position, wherein a lock secures the access door in the closed position, wherein when the lid is in the open position, the inner surface of the lid, the first fin, the second fin, and the first surface of the security screen define a portion of a staging compartment configured to receive a package, wherein the at least four sidewalls and the inner surface of the guide define a portion of a storage compartment, the storage compartment configured to store the package.

18. The package-storing device as recited in claim 17, wherein when the security screen is in the closed position the second surface of the security screen is in contact with the outer surface of the guide and the security screen covers the central opening of the guide, and wherein when the security screen is in the open position the security screen uncovers the central opening of the guide and a portion of the second surface of the security screen extends from one of the at least four sidewalls of the body towards the lid.

19. The package-storing device as recited in claim 17, wherein the security screen is operable to receive the package from the staging compartment to the storage compartment when the security screen transitions from the closed position to the open position.

20. The package-storing device as recited in claim 17, wherein the security screen inhibits access to the storage compartment when the lid is in the open position and the security screen is in the closed position.

21. The package-storing device as recited in claim 17, wherein the first fin, the second fin, and the security screen inhibit access to the storage compartment when the lid is in the open position and the security screen is in the open position.

22. The package-storing device as recited in claim 17, wherein the outer surface of the guide is semi-cylindrical in shape, wherein the security screen is semi-cylindrical in shape when the security screen is in the closed position.

23. The package-storing device as recited in claim 17, wherein the central opening through the guide is rectangular in shape.

24. The package-storing device as recited in claim 17, wherein the outer surface of the lid is substantially parallel to a horizontal plane when the lid is in the closed position, wherein the outer surface of the lid defines a bench seat.

25. The package-storing device as recited in claim 17, wherein the at least four sidewalls include a front sidewall, a rear sidewall opposite the front sidewall, a left sidewall, and a right sidewall opposite the left sidewall.

26. The package-storing device as recited in claim 25, wherein the front sidewall is parallel to the rear sidewall, wherein the left sidewall is parallel to the right sidewall.

27. The package-storing device as recited in claim 26, wherein the first fin and the second fin are perpendicular to the inner surface of the lid and parallel to the left sidewall and right sidewall of the body.

28. The package-storing device as recited in claim 17, wherein the access door comprises a drawer that is operable to slidably open and close.

29. The package-storing device as recited in claim 17, wherein the access door is hingedly connected to the body.

30. The package-storing device as recited in claim 17, wherein the lock is a key lock that comprises a latch configured to engage one of the at least four sidewalls.

31. The package-storing device as recited in claim 17, wherein the security screen is manufactured of a flexible material.

32. The package-storing device as recited in claim 17, wherein the body comprises a bottom wall defining an outer surface and an inner surface, wherein four or more feet are coupled to the outer surface of the bottom wall of the body, wherein at least one of the four or more feet contains an aperture configured to receive a connector therethrough to secure the body of the package-storing device to a horizontal surface.

33. The package-storing device as recited in claim 17, wherein one of the four or more sidewalls comprises a spacer bar coupled to an outer surface, the spacer bar operable to receive a connector therethrough to couple the body of the package-storing device to a vertical surface.

* * * * *